US007488014B2

(12) United States Patent
Nozawa et al.

(10) Patent No.: US 7,488,014 B2
(45) Date of Patent: Feb. 10, 2009

(54) DOOR OPENING/CLOSING DEVICE

(75) Inventors: Hideaki Nozawa, Yamanashi (JP); Jiro Mitsui, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 0 days.

(21) Appl. No.: 11/783,395

(22) Filed: Apr. 9, 2007

(65) Prior Publication Data

US 2008/0001412 A1 Jan. 3, 2008

(30) Foreign Application Priority Data

Jun. 30, 2006 (JP) ..... 2006-182427

(51) Int. Cl.
*E05C 3/06* (2006.01)

(52) U.S. Cl. ..... 292/216; 292/201; 292/DIG. 23

(58) Field of Classification Search ..... 292/216, 292/201, DIG. 23
See application file for complete search history.

(56) References Cited

U.S. PATENT DOCUMENTS 5,918,917 A * 7/1999 Elton et al. ..... 292/201
5,979,951 A * 11/1999 Shimura ..... 292/216
6,079,237 A * 6/2000 Hochart ..... 70/278.6
6,364,379 B1 * 4/2002 Roberts et al. ..... 292/216
6,520,548 B1 * 2/2003 Fisher et al. ..... 292/201
6,722,714 B2 4/2004 Ooe et al.
6,913,298 B2 * 7/2005 Inoue ..... 292/216
7,261,338 B2 * 8/2007 Spurr ..... 292/216
7,325,843 B2 * 2/2008 Coleman et al. ..... 292/216
2007/0284892 A1 * 12/2007 Nozawa ..... 292/216

FOREIGN PATENT DOCUMENTS

JP 2001 182402 7/2001

* cited by examiner

*Primary Examiner*—Patricia Engle
*Assistant Examiner*—Mark Williams
(74) *Attorney, Agent, or Firm*—Foley & Lardner LLP

(57) ABSTRACT

A door opening/closing device includes, between a door operating lever and an open-door latch unit, a first connection link connected to the door operating lever and a third wire cable. One end of the third wire cable is connected to the first connection link and the other end is connected to the open-door latch unit to connect the first connection link and the open-door latch unit to each other.

3 Claims, 21 Drawing Sheets

DOOR OPENING/CLOSING DEVICE

BACKGROUND OF THE INVENTION

This application claims priority from Japanese Patent Application No. 2006-182427, filed Jun. 30, 2006, which is incorporated herein by reference in its entirety.

1. Field of the Invention

The present invention relates to a door opening/closing device that permits an opening movement of a door with respect to a vehicle body by releasing a closed-door holding mechanism (CR) when an inside handle is operated to open the door, and permits a closing movement of the door with respect to the vehicle body by releasing an open-door holding mechanism when the inside handle is operated to close the door.

2. Description of the Related Art

A vehicle having a slide door usually has a closed-door holding means and an open-door holding means provided between a vehicle body and the slide door. The closed-door holding means holds the slide door in a closed state with respect to the vehicle body, and on the other hand, the open-door holding means holds the slide door in an open state with respect to the vehicle body.

A door opening/closing device used for the vehicle of the type generally includes a door opening lever that releases the closed-door holding means when an inside handle is turned to open the door and a door closing lever that releases the open-door holding unit when the inside handle is turned to close the door. If the inside handle is operated to open the door when the slide door is in the closed state, the closed-door holding means is released by the turning of the door opening lever, so that the slide door can be moved to open. On the other hand, if the inside handle is operated to close the door when the slide door is in the open state, the open-door holding means is released by the turning of the door closing lever, so that the slide door can be moved to close (for example, see Japanese Patent No. 2001-182402).

In the above door opening/closing device, because the inside handle and the door opening lever and door closing lever are configured as an integral mechanism, when these elements are installed on a vehicle, these elements need not be handled individually, so that the door opening/closing device can be installed easily. However, work for installing a link rod and a wire cable between the inside handle and the door opening lever and door closing lever to transmit the power needs be performed, so that the assembling work of the door opening/closing device itself is very troublesome.

SUMMARY OF THE INVENTION

It is an object of the present invention to at least partially solve the problems in the conventional technology.

According to an aspect of the present invention, a door opening/closing device that permits an opening movement of a door with respect to a vehicle body by releasing a closed-door holding mechanism when an inside handle is operated to open the door, and that permits a closing movement of the door with respect to the vehicle body by releasing an open-door holding mechanism when the inside handle is operated to close the door includes a door operating lever that releases the closed-door holding mechanism when being turned to a first direction and releases the open-door holding mechanism when being turned to a second direction is arranged on a base plate by means of a rotating shaft member, and an operation output mechanism is formed on the inside handle so as to engage with the door operating lever, wherein when the inside handle is operated to open or close the door, the door operating lever is turned in a desired direction by bringing the operation output mechanism into contact with the door operating lever; and a link member, arranged between the door operating lever and the open-door holding unit and connected to the door operating lever and a connecting member, one end of which is connected to the link member and other end of which is connected to the open-door holding unit to connect the link member and the open-door holding unit to each other, and when the door operating lever is turned to the second direction, the link member releases the open-door holding unit via the connecting member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be described in detail with reference to the accompanying drawings.

Figure 1:
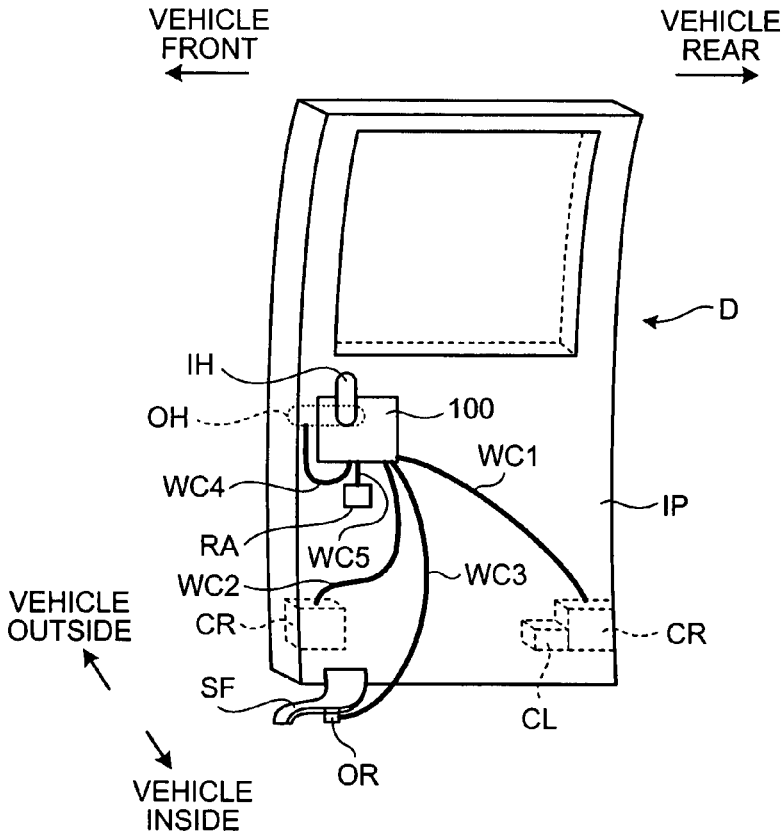
FIG. 1 is a perspective view of a slide door that includes a door opening/closing device according to an embodiment of the present invention.
Figure 2:
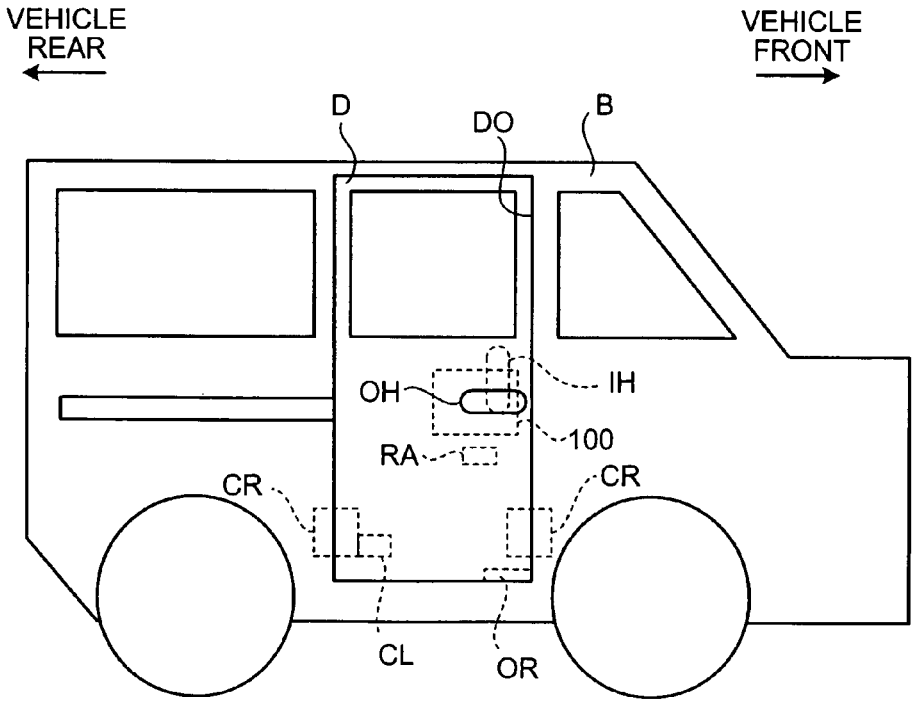
FIG. 2 is a side view of a four-wheel vehicle with the slide door shown in FIG. 1.

FIG. 1 schematically shows a door opening/closing device according to an embodiment of the present invention. The door opening/closing device is configured so that when an inside handle IH is operated or when an outside handle OH is operated, a control unit 100 is operated appropriately to control the operation of any one of a closed-door latch unit CR and an open-door latch unit OR and both. The closed-door latch unit CR and the open-door latch unit OR are provided between a vehicle body B of a four-wheel vehicle and a slide door D as shown in FIG. 2.

A slide door D that employs the door opening/closing device opens and closes an ingress-egress opening DO by sliding back and forth along the side of the vehicle body B. Only the sliding door D arranged on the right-hand side of the vehicle body B (for a right-hand drive vehicle, a door arranged on the rear side of driver seat) is explained below. Because, the slide door arranged on the left-hand side of the vehicle body B has a structure symmetrical to that of the sliding door D arranged on the right-hand side.

The closed-door latch unit CR forms a closed-door holding unit that (mechanism) holds the slide door D in the closed state with respect to the vehicle body B. The closed-door latch unit CR is provided between the rear edge portion of the slide door D and the vehicle body B, and is also provided between the front edge portion of the slide door D and the vehicle body B. The closed-door latch unit CR provided between the rear edge portion of the slide door D and the vehicle body B has a closer device CL. The closer device CL, which is an actuator incorporating a clutch mechanism (not shown), functions so as to transfer the closed-door latch unit CR into a fully latched state on condition that the clutch mechanism is in the engaged state when the closed-door latch unit CR becomes in a half latched state. The closed-door latch unit CR is configured so that even during the time when the closed-door latch unit CR transfers from the half latched state to the fully latched state, if the clutch mechanism turns from the engaged state to the disengaged state, the transfer operation is immediately interrupted.

The open-door latch unit OR forms an open-door holding unit that holds the slide door D in the open state with respect to the vehicle body B, and is provided between a support frame SF provided on the slide door D and the vehicle body B. The support frame SF is a unit that serves as a guide when the slide door D is slidingly moved with respect to the vehicle body B. The support frame SF is provided so as to project from the front lower end portion of a door inner panel IP toward the inside of vehicle.

Although not shown in the figures, the closed-door latch unit CR and the open-door latch unit OR have the same construction as those of the typical example: for example, the closed-door latch unit CR and the open-door latch unit OR have a latch engaging toothingly with a striker provided on the vehicle body B and a ratchet that controls the movement of the latch.

FIGS. 3 to 13 show a construction example of the control unit 100 used in this embodiment. The control unit 100 typically shown in these figures is mounted on an outer surface upper part on the vehicle interior side on the door inner panel IP of the slide door D via a base plate 101. The control unit 100 has an inside-handle lever shaft 102, which is a rotating shaft member, provided on the base plate 101. Also, in the control unit 100, a door operating lever 110 and a link lever 120 are provided on the inside-handle lever shaft 102, and a child lock lever 130 is provided in a portion surrounding the inside-handle lever shaft 102 on the base plate 101.

Figure 5:
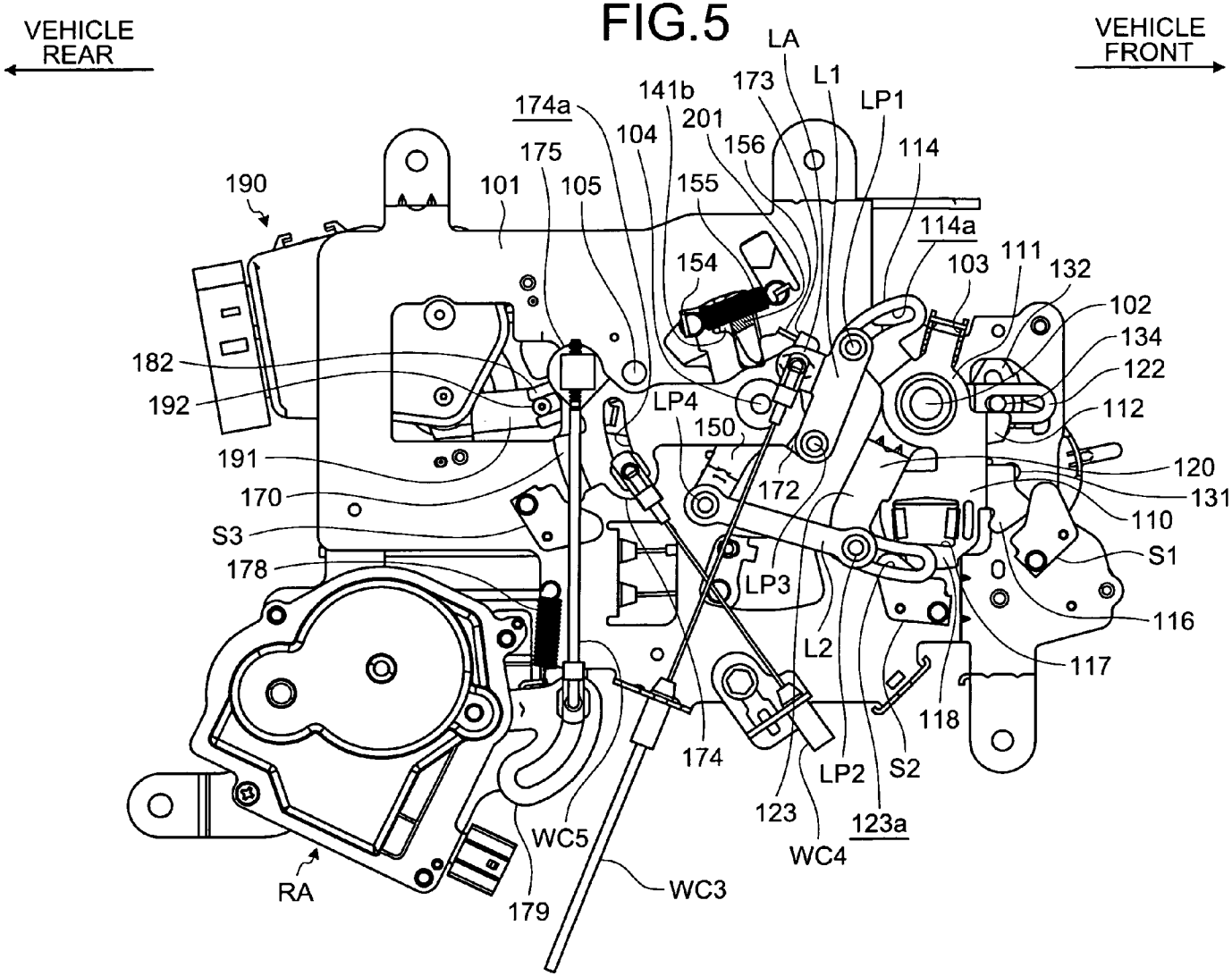
FIG. 5 is depicts a detailed structure of the control unit shown in FIG. 3 as viewed from outside of the vehicle (hereinafter, "vehicle exterior side")
Figure 6:
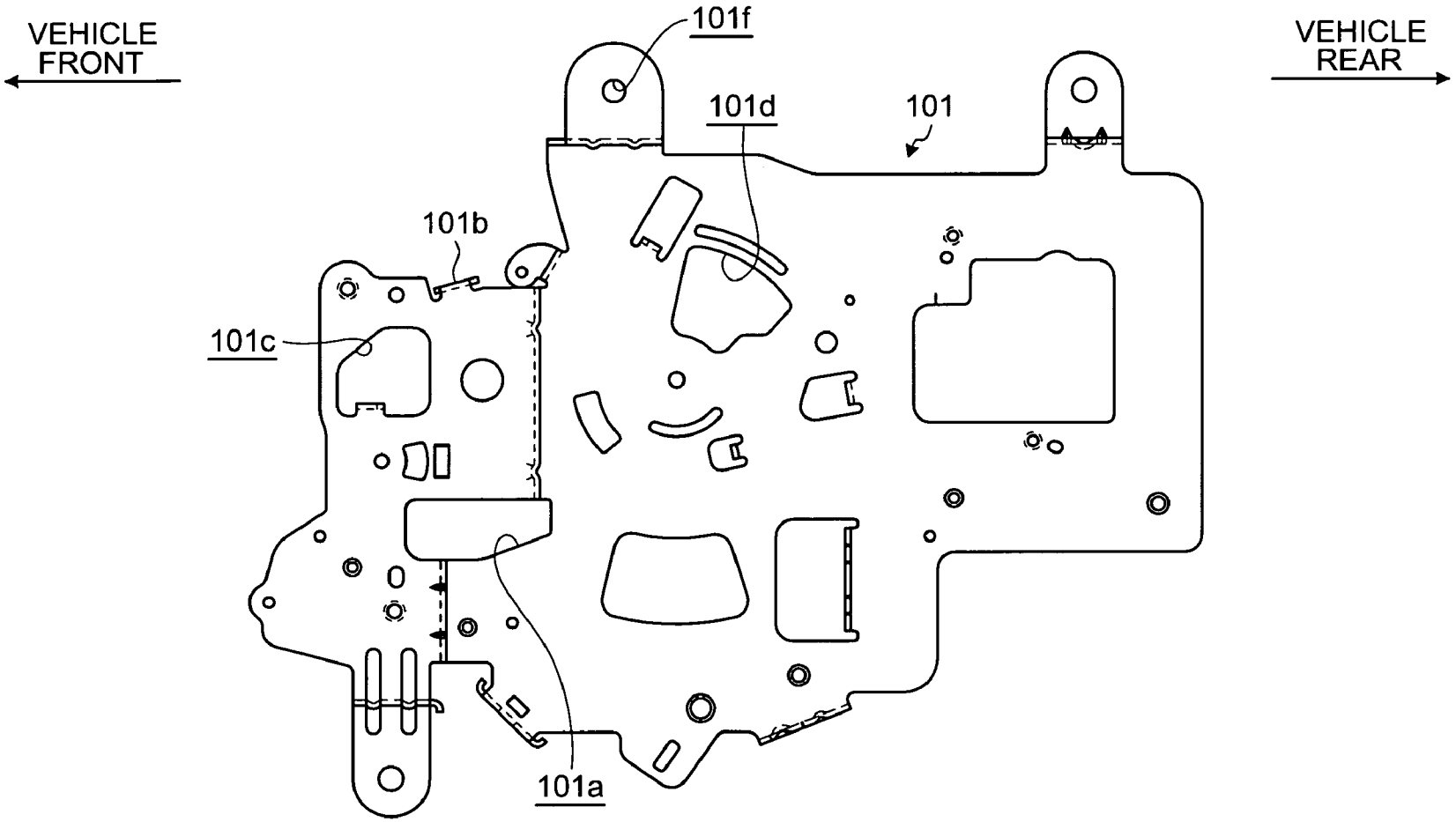
FIG. 6 is a view of a base plate in the control unit shown in FIG. 3 as viewed from the vehicle interior side.
Figure 7:
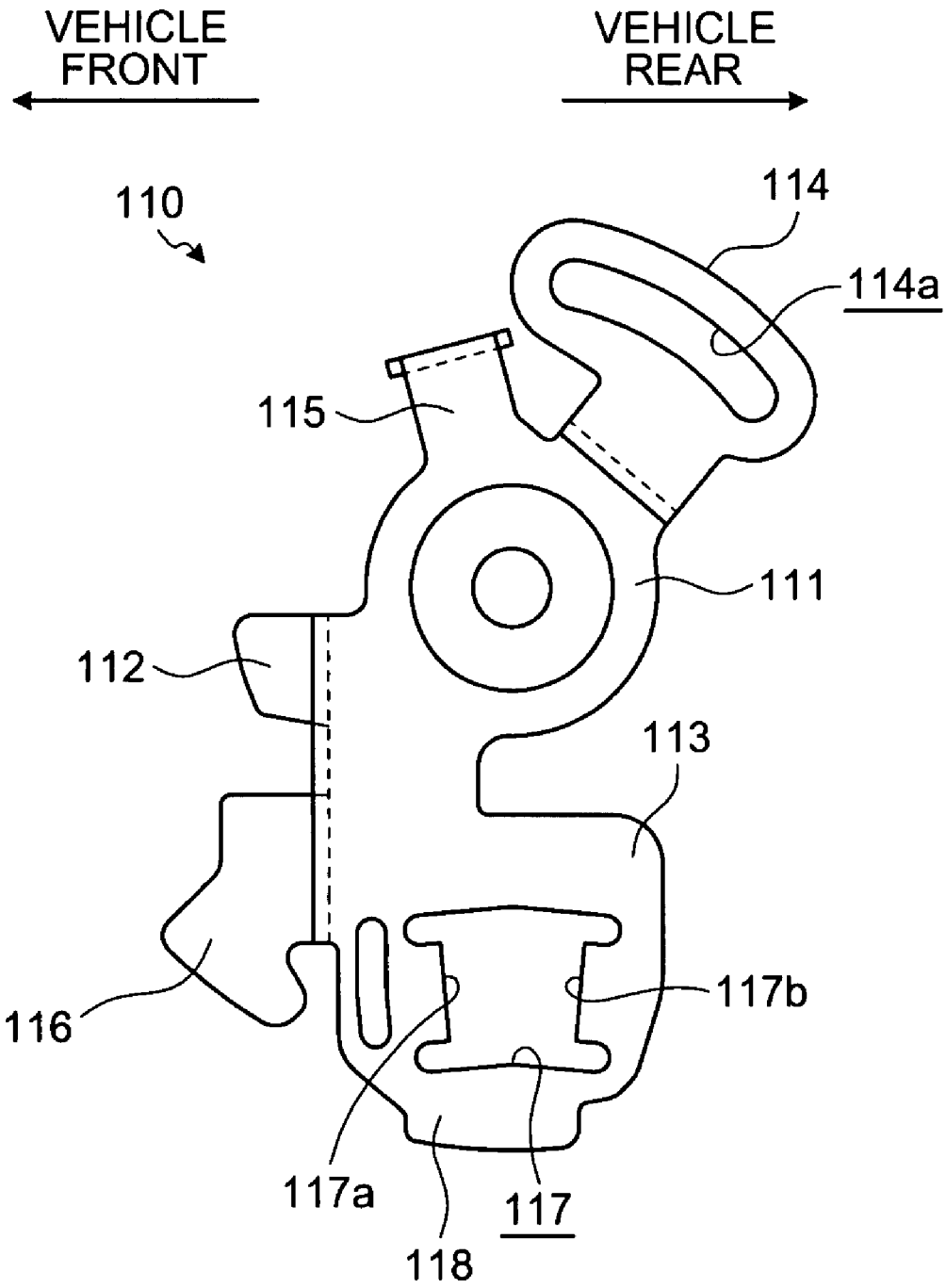
FIG. 7 is a view of a door operating lever in the control unit shown in FIG. 3 as viewed from the vehicle interior side.

As shown in FIG. 5, the door operating lever 110 is arranged at the tip end of the inside-handle lever shaft 102 so as to turn around the axis of the inside-handle lever shaft 102 on the back surface side of the base plate 101 (the vehicle outside), and, as shown in FIG. 7, has a link engagement unit 112, an inside-handle engagement unit 113, a first link-slide connecting unit 114, and a first spring-engagement unit 115, which are provided around a disc-shaped operating lever base 111.

The link engagement unit 112 is a unit that extends from a portion located on the vehicle front side of the operating lever base 111 toward the vehicle front side.

The inside-handle engagement unit 113 is a unit that extends from a portion located on the lower side of the operating lever base 111 substantially toward the downside, and has an extension end portion formed so as to be wide toward the vehicle rear side. The inside-handle engagement unit 113 is formed so as to have a length sufficiently larger than the link engagement unit 112. The inside-handle engagement unit 113 has a door-opening detecting unit 116 provided in a side edge portion located on the vehicle front side, and also has an output-unit engagement hole 117 and a door-closing detecting unit 118, which are provided in the wide extension end portion.

Figure 4:
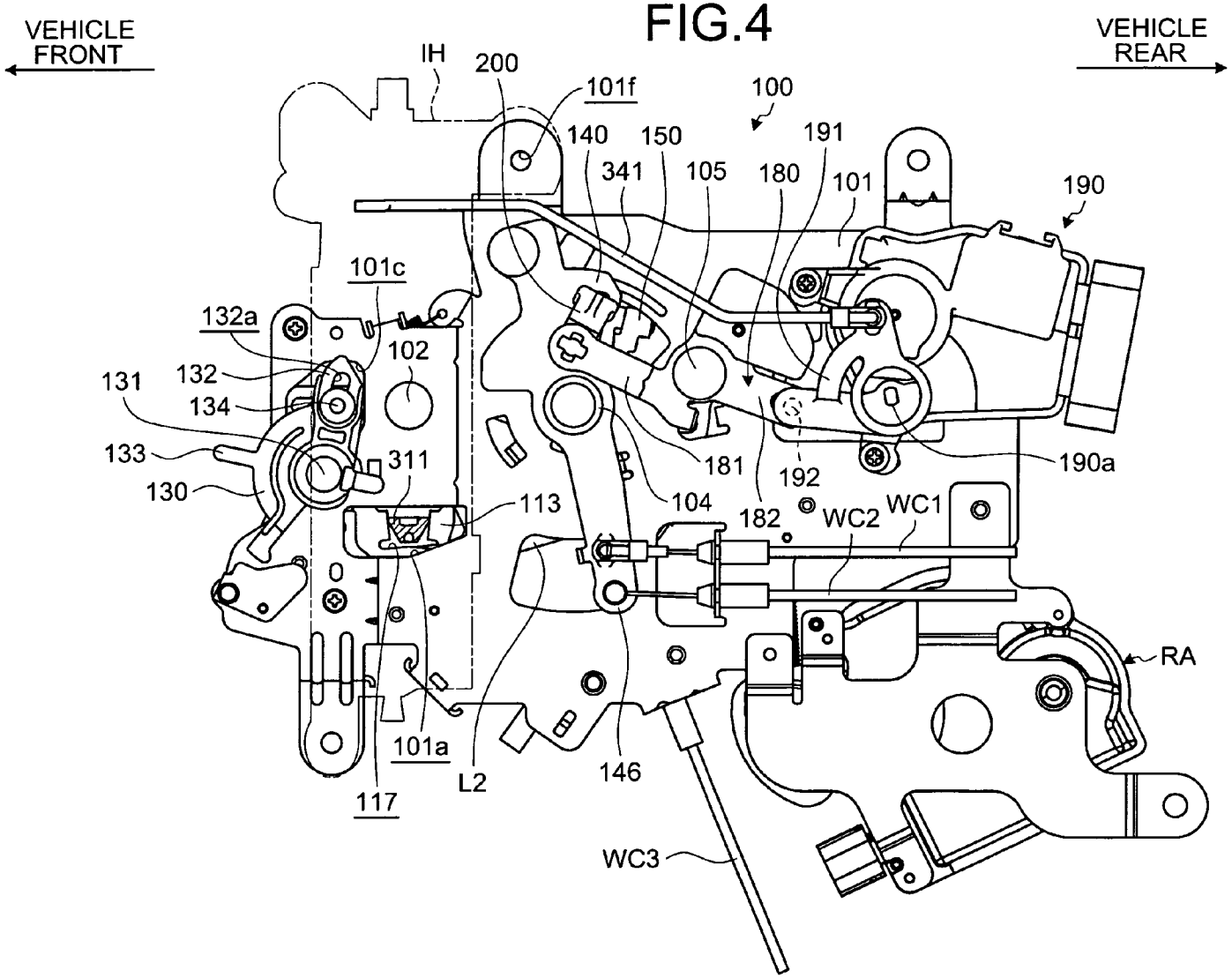
FIG. 4 depicts a detailed structure of the control unit shown in FIG. 3 as viewed from the vehicle interior side.

The door-opening detecting unit 116 is a unit that extends toward the vehicle front side so as to be inclined downward and then extends toward the vehicle rear side so as to be inclined downward. The door-opening detecting unit 116 separates from a first door-operation detecting sensor S1 provided on the base plate 101 when the inside-handle engagement unit 113 is in a downward extending state, and on the other hand, comes into contact with the first door-operation detecting sensor S1 to turn on the sensor S1 when the door operating lever 110 turns counterclockwise in FIG. 5. The output-unit engagement hole 117 is formed in the extension end portion of the inside-handle engagement unit 113 so as to form a front-side contact surface 117*a* in a portion located on the vehicle front side and a rear-side contact surface 117*b* in a portion located on the vehicle rear side. As shown in FIG. 4, a portion in which the output-unit engagement hole 117 is formed in the inside-handle engagement unit 113 is exposed to the top surface side (the vehicle inside) via an insertion window hole 101*a* formed in the base plate 101. The door-closing detecting unit 118 is a unit projecting from the tip end of the inside-handle engagement unit 113 in the diameter outside direction of the inside-handle lever shaft 102. The door-closing detecting unit 118 separates from a second door-operation detecting sensor S2 provided on the base plate 101 when the inside-handle engagement unit 113 is in a downward extending state, and on the other hand, comes into contact with the second door-operation detecting sensor S2 to turn on the sensor S2 when the door operating lever 110 turns clockwise in FIG. 5.

The first link-slide connecting unit 114, which is a unit that extends from a portion located on the upper side of the operating lever base 111 toward the vehicle rear side so as to be inclined upward, has a first slide groove hole 114*a* in the extension end portion thereof. The first slide groove hole 114*a* is a narrow cutout formed into an arc shape with the axis of the inside-handle lever shaft 102 being the center. As shown in FIG. 5, to the first link-slide connecting unit 114, one end of a first connection link (link member) L1 is connected so that a connection pin LP1 is inserted through the first slide groove hole 114*a*. The connection pin LP1 connects the first connection link L1 to the first link-slide connecting unit 114 in an oscillatable manner.

The first spring-engagement unit 115 is a unit that extends from a portion located on the upper side of the operating lever base 111 toward the upside. With the first spring engagement unit 115, a return spiral spring 103 is engaged, the return spiral spring 103 shown in FIG. 5 being provided between the first spring-engagement unit 115 and a spring engagement base 101*b* provided on the base plate 101 shown in FIG. 6. The return spiral spring 103 serves to hold the door operating lever 110 at the normal position at which the inside-handle engagement unit 113 extends downward.

Figure 8:
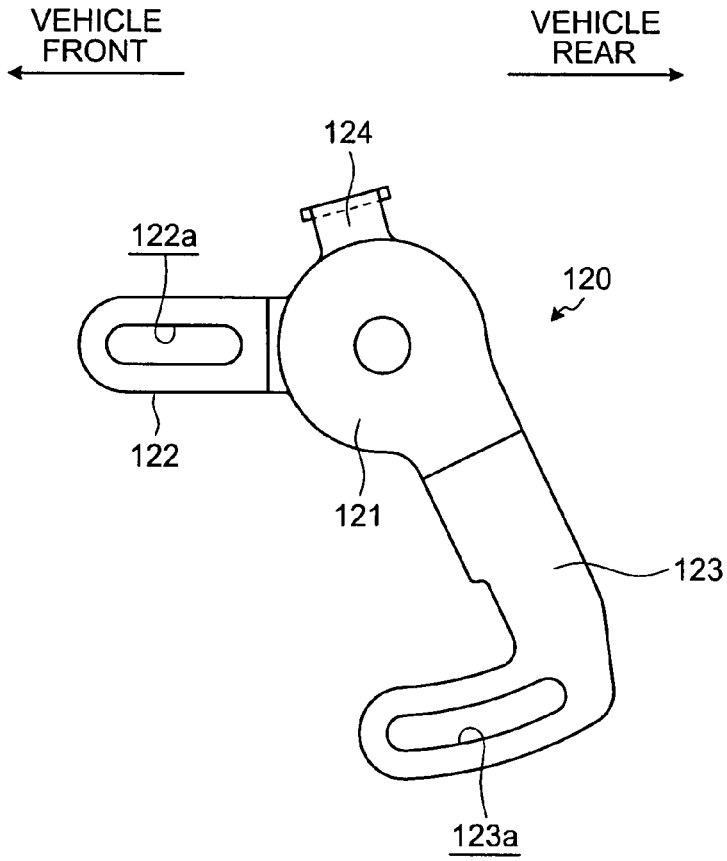
FIG. 8 is a view of a link lever in the control unit shown in FIG. 3 as viewed from the vehicle interior side.

As shown in FIG. 5, the link lever 120 is located between the base plate 101 and the door operating lever 110 on the back surface side of the base plate 101, and is arranged on the inside-handle lever shaft 102 so as to be turnable around the axis of the inside-handle lever shaft 102. As shown in FIG. 8, the link lever 120 has a pin slide unit 122, a link-slide connecting unit 123, and a second spring-engagement unit 124, which are provided around a disc-shaped link lever base 121.

As shown in FIGS. 5 and 8, the pin slide unit 122, which is a unit that extends from a portion located on the vehicle front side of the link lever base 121 toward the vehicle front side, is formed so as to have a length longer than the link engagement unit 112 of the door operating lever 110. In the pin slide unit 122, a pin slide groove 122*a* is provided so as to extend in the radial direction with respect to the axis of the inside-handle lever shaft 102. The second link-slide connecting unit 123, which is a unit that extends from a portion located on the lower side of the link lever base 121 toward the vehicle rear side so as to be inclined downward and then bendingly extends toward the vehicle front side, has a second slide groove hole 123*a* in the portion that extends toward the vehicle front side. The second slide groove hole 123*a* is a narrow cutout formed into an arc shape with the axis of the inside-handle lever shaft 102 being the center. To the second link-slide connecting unit 123, one end of a second connection link L2 is connected so that a second connection pin LP2 is inserted through the second slide groove hole 123*a*. The second connection pin LP2 connects the second connection link L2 to the second link-slide connecting unit 123 in an oscillatable manner.

The second spring-engagement unit 124 is a unit that extends upward along the first spring-engagement unit 115 of the door operating lever 110 from a portion located on the upside of the link lever base 121 when the pin slide unit 122 extends along the link engagement unit 112 of the door operating lever 110. With the second spring-engagement unit 124, the return spiral spring 103 is engaged, the return spiral spring 103 being engaged with the first spring-engagement unit 115 of the door operating lever 110. The return spiral spring 103 has a function of always holding the pin slide unit 122 at the normal position at which the pin slide unit 122 extends along the link engagement unit 112 of the door operating lever 110 with respect to the link lever 120.

Figure 9:
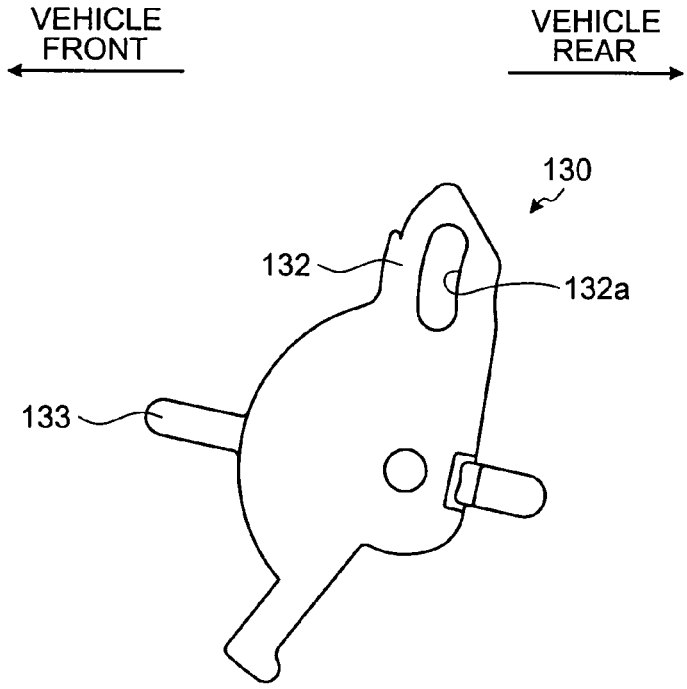
FIG. 9 is a view of a child lock lever in the control unit shown in FIG. 3 as viewed from the vehicle interior side.

As shown in FIG. 4, the child lock lever. 130 is turnably arranged in a portion on the vehicle front side of the inside-handle lever shaft 102 on the top surface side of the base plate 101 via a child-lock lever shaft 131, and has a pin-operating unit 132 and a switching operating unit 133 as shown in FIG. 9.

As shown in FIGS. 4, 5, and 9, the pin-operating unit 132, which is a unit that extends from the child-lock lever shaft 131 in the direction such as to intersect the pin slide unit 122 of the link lever 120, has a pin-operating groove 132*a*. The pin-operating groove 132*a* extends along the lengthwise direction of the pin-operating unit 132, and has an engagement pin 134 therein. The engagement pin 134 is arranged so as to be slidable along the lengthwise direction of the pin-operating groove 132*a*. The end portion located on the vehicle outside of the engagement pin 134 projects to the back surface side via a pin insertion opening 101*c* in the base plate 101, and engages with the pin slide groove 122*a* in the link lever 120 described above.

The switching operating unit 133 is a unit that switches over the child lock lever 130 from the unlock position to the lock position and vice versa, and is a unit that extends from the child-lock lever shaft 131 toward the vehicle front side so as to project from the front end edge of the base plate 101. The child lock lever 130 has a function such that when being positioned at the unlock position, in the pin slide unit 122 of the link lever 120, the engagement pin 134 is positioned in the rotational movement region of the link engagement unit 112 of the door operating lever 110, and on the other hand, when being positioned at the lock position, in the pin slide unit 122 of the link lever 120, the engagement pin 134 is positioned out of the rotational movement region of the link engagement unit 112 of the door operating lever 110.

Also, as shown in FIG. 4, the control unit 100 has a lever shaft 104, which is a second rotating-shaft member, in a portion on the vehicle rear side of the inside-handle lever shaft 102 on the base plate 101, and has a locking lever shaft 105, which is a third rotating-shaft member, in a portion on the vehicle rear side of the lever shaft 104. On the lever shaft 104, an open lever 140, an open sub lever 150, and an open handle lever 170 that is a second door-operating lever are arranged. Although arranged on the common lever shaft 104, these open lever 140, open sub lever 150, and open handle lever 170 can be turned individually around the axis of the lever shaft 104. Also, on the locking lever shaft 105, a locking lever 180 is arranged.

Figure 3:
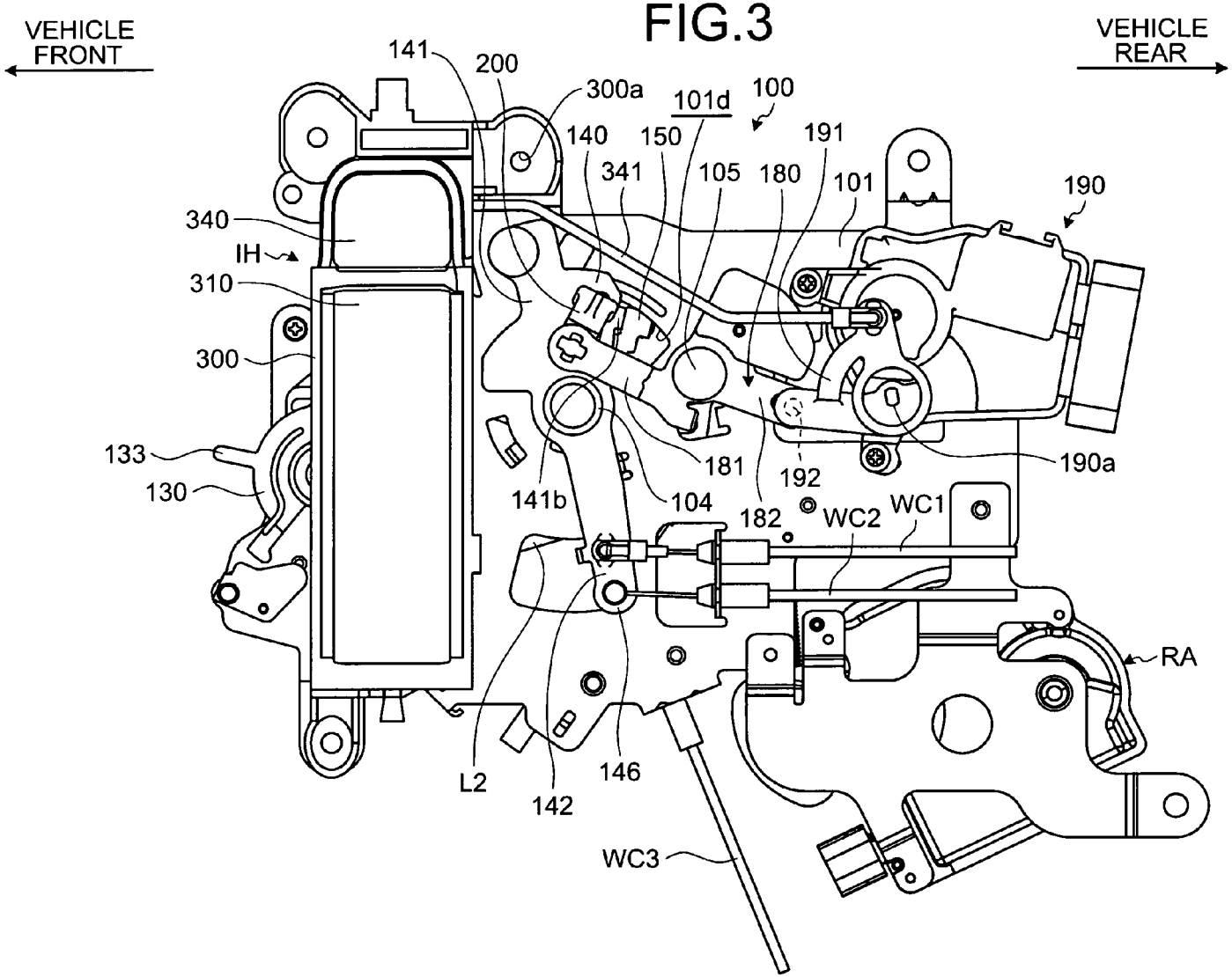
FIG. 3 is a view of a control unit for the door opening/closing device shown in FIG. 1 as viewed from inside of the vehicle (hereinafter, "vehicle interior side")
Figure 10:
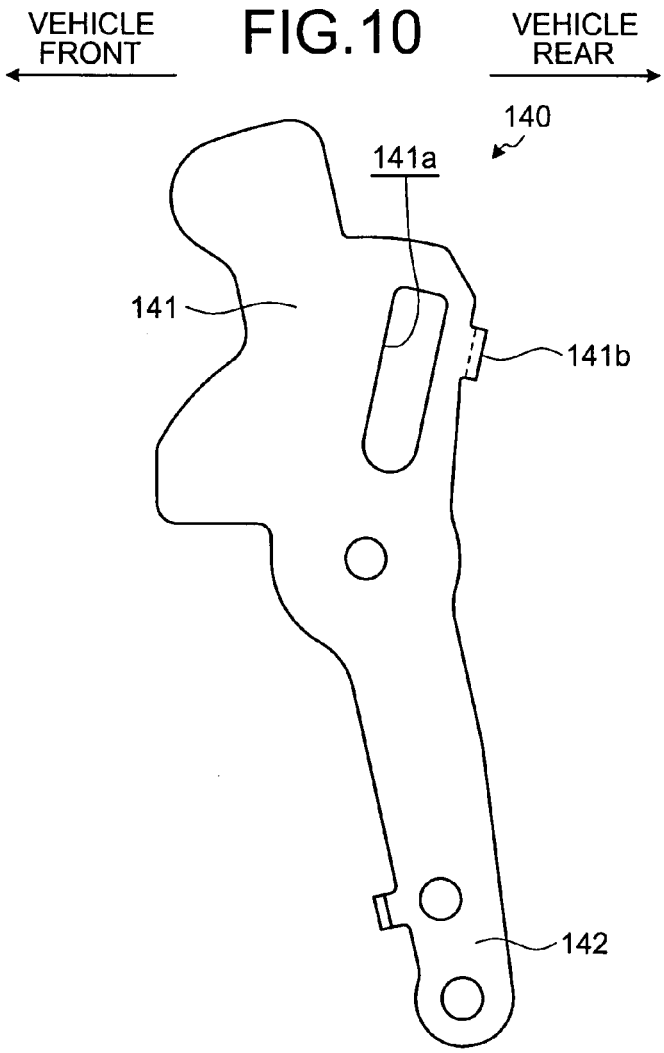
FIG. 10 is a view of an open lever in the control unit shown in FIG. 3 as viewed from the vehicle interior side.

As shown in FIGS. 3 and 4, the open lever 140 is arranged on the inside-handle lever shaft 102 so as to turn around the axis of the lever shaft 104 on the top surface side of the base plate 101, and has a sub-lever engagement unit 141 and a wire-cable connecting unit 142 as shown in FIG. 10.

As shown in FIGS. 3, 4, and 10, the sub-lever engagement unit 141, which is a unit that extends from the lever shaft 104 toward the upside, has a lock-pin slide groove 141*a* and an engagement convex portion 141*b*. The lock-pin slide groove 141*a* is a groove formed into a straight line shape so as to extend in the radial direction with respect to the axis of the lever shaft 104. The engagement convex portion 141*b*, which is a portion that bendingly extends from the edge along the vehicle rear side of the sub-lever engagement unit 141 toward the base plate 101, projects to the back surface side of the base plate 101 via a lever penetrating hole 101*d* provided in the base plate 101 shown in FIG. 6.

As shown in FIGS. 3, 4, and 10, the wire-cable connecting unit 142 is a unit that extends downward from the lever shaft 104 so as to be inclined slightly to the vehicle rear side. To the wire-cable connecting unit 142, one end of a first wire cable WC1 and one end of a second wire cable WC2 are connected. As shown in FIG. 1, the other end of the first wire cable WC1 is connected to the closed-door latch unit CR at the rear edge of the slide door D. When being pulled, the first wire cable WC1 releases the closed-door latch unit CR, and also switches over the clutch mechanism of the closer device CL that the closed-door latch unit CR has from the engaged state to the disengaged state. The other end of the second wire cable WC2 is connected to the closed-door latch unit CR at the front edge of the slide door D. When being pulled, the second wire cable WC2 releases the closed-door latch unit CR.

Figure 11:
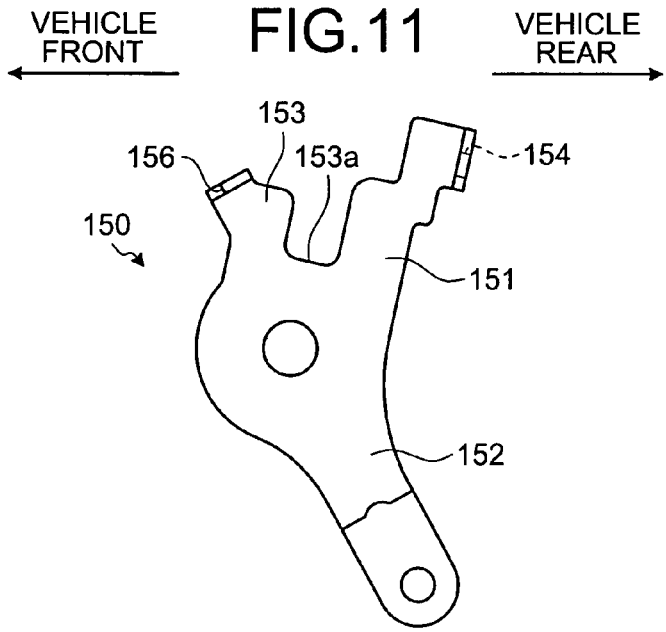
FIG. 11 is a view of an open sub lever in the control unit shown in FIG. 3 as viewed from the vehicle interior side.

As shown in FIG. 5, the open sub lever 150 is arranged on the lever shaft 104 so as to turn around the axis of the lever shaft 104 on the back surface side of the base plate 101, and has an open-lever engagement unit 151, a second link-connecting unit 152, and a lock-pin engagement unit 153 as shown in FIG. 11.

As shown in FIG. 5 and 11, the open-lever engagement unit 151, which is a unit that extends upward from the lever shaft 104 so as to be inclined slightly to the vehicle rear side, engages contactingly with the engagement convex portion 141*b* of the open lever 140 via the side surface on the vehicle front side thereof. To the open-lever engagement unit 151, one end of a first coil spring 155 is connected via a coil-spring connecting unit 154. The first coil spring 155 is interposed between the open sub lever 150 and the base plate 101 to always urge the open sub lever 150 clockwise in FIG. 5.

The second link-connecting unit 152 is a unit that extends downward from the lever shaft 104 so as to be inclined slightly to the vehicle rear side. To the second link-connecting unit 152, the other end of the connection link L2 is connected.

The lock-pin engagement unit 153 is a unit that extends along the sub-lever engagement unit 141 of the open lever 140 in a state in which an engagement concave portion 153*a* agreeing with the lock-pin slide groove 141*a* is secured between the lock-pin engagement unit 153 and the open-lever engagement unit 151 when the open-lever engagement unit 151 engages contactingly with the sub-lever engagement unit 141 via the engagement convex portion 141*b*. The lock-pin engagement unit 153 is constructed so as to be sufficiently shorter than the lock-pin slide groove 141*a* in the open lever 140. Also, the lock-pin engagement unit 153 has a handle lever engagement unit 156. The handle lever engagement unit 156 is a unit that is bent from the extension end of the lock-pin engagement unit 153 toward the vehicle outside.

Figure 12:
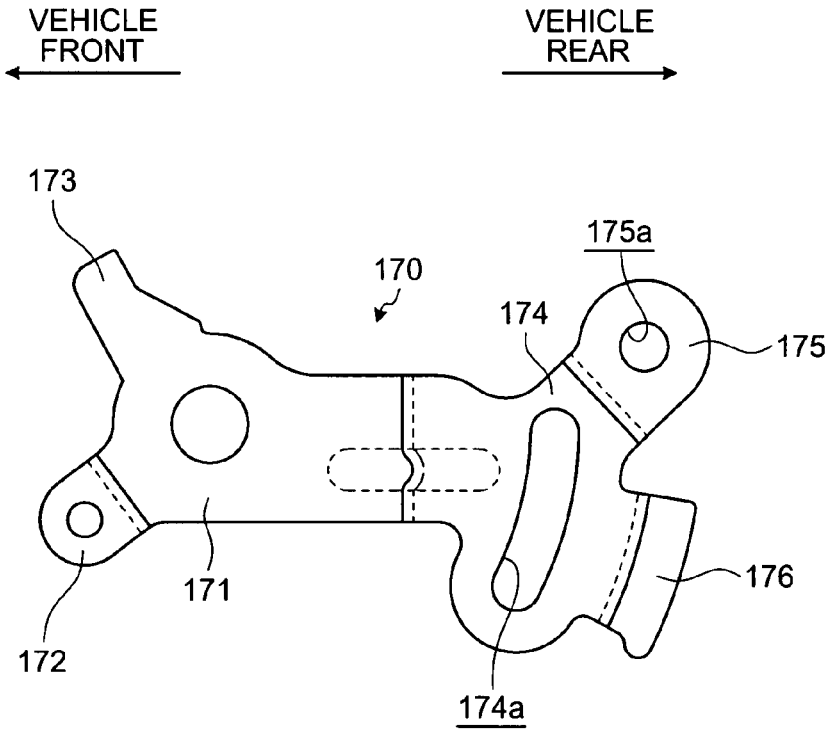
FIG. 12 is a view of an open handle lever in the control unit shown in FIG. 3 as viewed from the vehicle interior side.

As shown in FIG. 5, the open handle lever 170 is arranged in a portion on the outermost side of vehicle on the lever shaft 104 on the back surface side of the base plate 101, and has a first link-connecting unit 172, a sub-lever engagement unit 173, a wire-cable-slide connecting unit 174, a wire-cable connecting unit 175, and a third door-operation detecting unit 176, which are provided around a disc-shaped handle lever base 171, as shown in FIG. 12. When the outside handle OH is operated to open the door, and when the outside handle OH is operated to close the door, the open handle lever 170 turns in a first direction, by which the closed-door latch unit CR is released, and also the open-door latch unit OR is released.

As shown in FIGS. 5 and 12, the first link-connecting unit 172 is a unit that extends from a portion located on the lower side of the handle lever base 171 toward the vehicle front side so as to be inclined downward. On the first link-connecting unit 172, a third connection pin LP3, which is a third rotating-shaft member, is arranged, and to the third connection pin LP3, the other end of the first connection link L1 is connected. The third connection pin LP3 connects the first connection link L1 to the first link-connecting unit 172 in an oscillatable manner. On the first connection link L1, a third wire-cable connecting unit LA is arranged between one end and the other end. To the third wire-cable connecting unit LA, one end of a third wire cable WC3, which is a connecting member, is connected. As shown in FIG. 1, the other end of the third wire cable WC3 is connected to the open-door latch unit OR. That is to say, the third wire cable WC3 connects the first connection link L1 to the open-door latch unit OR, and releases the open-door latch unit OR when one end thereof is pulled.

As shown in FIGS. 5 and 12, the sub-lever engagement unit 173 is a unit that extends from a portion located on the upper side of the handle lever base 171 toward the vehicle front side so as to be inclined upward. The second lever-engagement unit 173 is in contact with the end surface located on the vehicle front side of the handle lever engagement unit 156 of the open sub lever 150 via the side surface directed to the upside thereof.

As shown in FIGS. 5 and 12, the wire-cable-slide connecting unit 174 is a unit that extends from a portion located on the vehicle rear side of the handle lever base 171 toward the vehicle rear side. To the wire-cable-slide connecting unit 174, one end of a fourth wire cable WC4 is connected via a wire-connecting groove hole 174*a* so as to be slidable. The wire-connecting groove hole 174*a* is a narrow cutout having an arcuate shape with the axis of the lever shaft 104 being the center. The other end of the fourth wire cable WC4 is connected to the outside handle OH shown in FIG. 1 via a bell crank (not shown). Usually, no tension is produced on the fourth wire cable WC4. However, when the outside handle OH is operated, tension is produced on the fourth wire cable WC4 by the operation, and the tension oscillates the open handle lever 170 counterclockwise in FIG. 5.

As shown in FIGS. 5 and 12, the wire-cable connecting unit 175 is a unit projecting from the tip end of the wire-cable-slide connecting unit 174 in the diameter outside direction of the lever shaft 104. To the wire-cable connecting unit 175, one end of a fifth wire cable WC5 is connected via a wire connecting hole 175*a*. The other end of the fifth wire cable WC5 is connected to an output lever 179 of a release actuator RA. Usually, the tip end of the output lever 179 is in a state of being positioned on the vehicle front side by the tension of a third coil spring 178, and thus no tension is produced. When the release actuator RA is driven from the state by triggering the ON state of, for example, the door-operation detecting sensor S1, S2, the tip end of the output lever 179 oscillates downward in FIG. 5. Tension is produced on the fifth wire cable WC5 by the oscillation, by which the open handle lever 170 is oscillated counterclockwise in FIG. 5.

As shown in FIGS. 5 and 12, the third door-operation detecting unit 176 is a unit projecting from the tip end lower portion of the wire-cable-slide connecting unit 174 in the diameter outside direction of the lever shaft 104. When the wire-cable-slide connecting unit 174 is in a state of extending from the handle lever base 171 toward the vehicle rear side, the third door-operation detecting unit 176 separates from a third door-operation detecting sensor S3 provided on the base plate 101. On the other hand, when the open handle lever 170 turns counterclockwise in FIG. 5, the third door-operation detecting unit 176 comes into contact with the third door-operation detecting sensor S3 to turn on the sensor S3.

Figure 14:
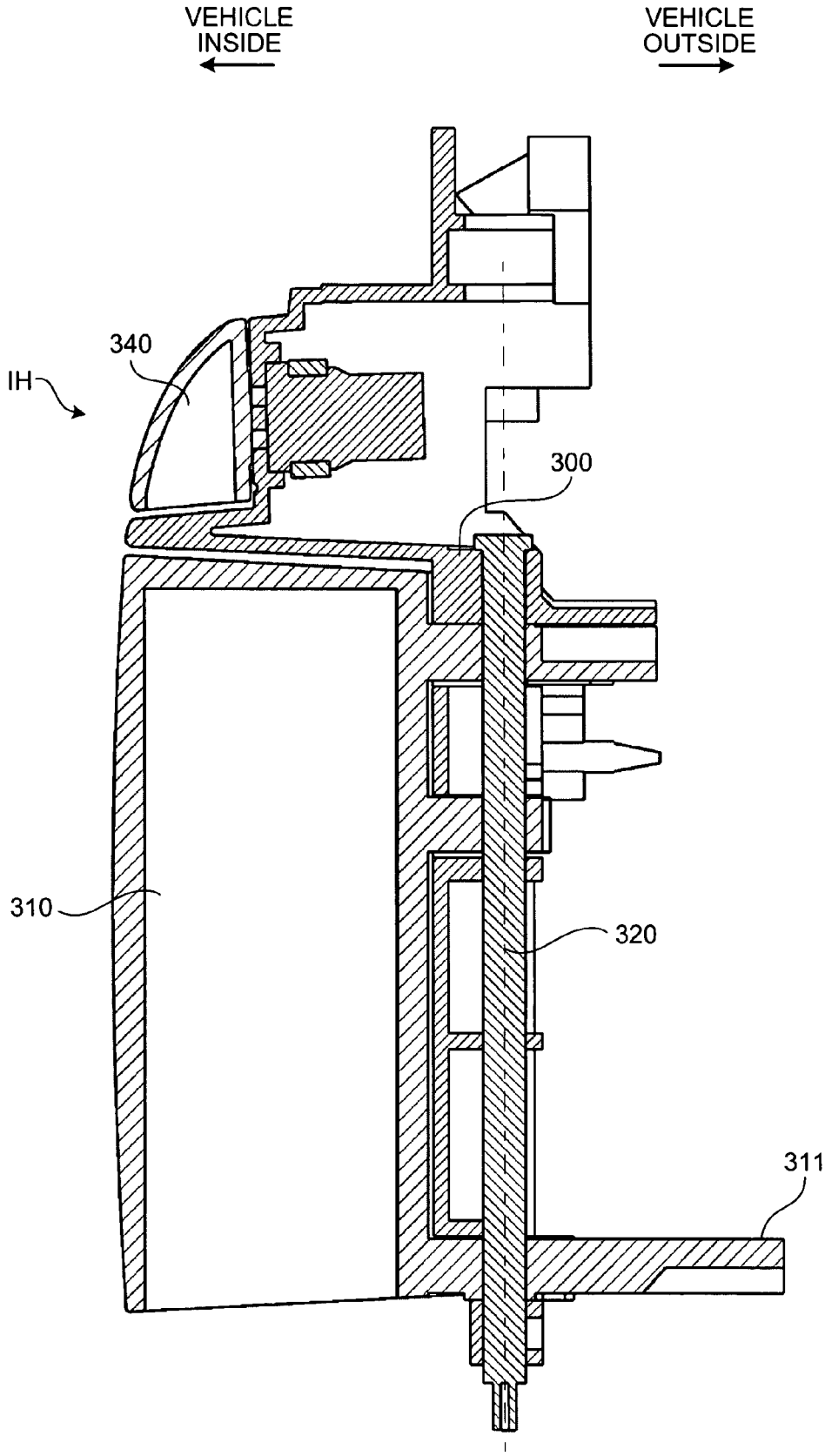
FIG. 14 is a sectional side view of an inside handle in the door opening/closing device shown in FIG. 1.

As shown in FIGS. 3 and 4, the locking lever 180 is arranged on the top surface side of the base plate 101, and has a lock-pin holding unit 181 and an actuator engagement unit 182 as shown in FIG. 14.

Figure 13:
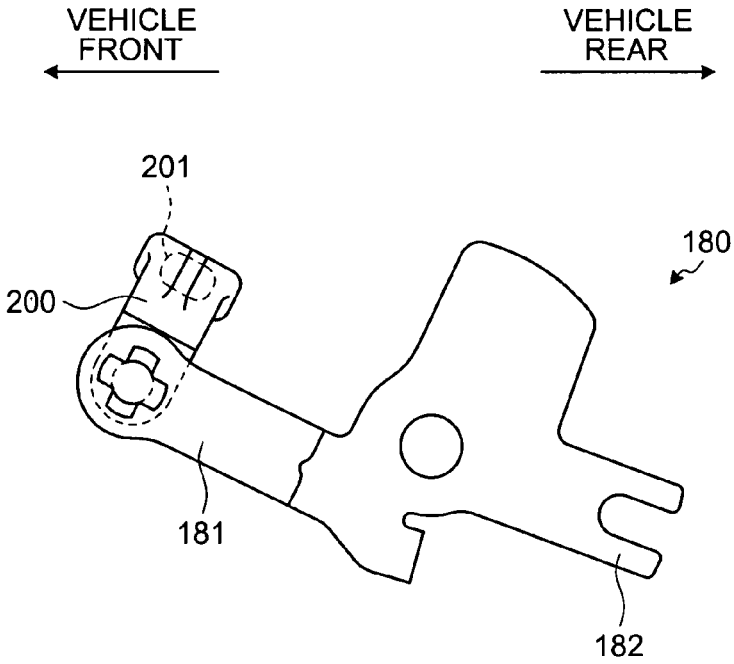
FIG. 13 is a view of a locking lever in the control unit shown in FIG. 3 as viewed from the vehicle interior side.

As shown in FIGS. 3, 4, and 13, the lock-pin holding unit 181 is a unit that extends from the locking lever shaft 105 toward the vehicle front side. In the extension end portion of the lock-pin holding unit 181, a lock member 200 is provided. The lock member 200 is turnably supported on the lock-pin holding unit 181 via the base end portion thereof, and has a lock pin 201 in the tip end portion thereof. The lock pin 201 is a columnar member projecting from the tip end of the lock member 200 toward the base plate 101, and the projecting end portion thereof penetrates the lock-pin slide groove 141*a* in the open lever 140, and further penetratetes the lever penetrating hole 101*d* provided in the base plate 101. Therefore, the lock pin 201 can engage with the engagement concave portion 153*a* provided between the open-lever engagement unit 151 of the open sub lever 150 and the lock-pin engagement unit 153.

As shown in FIGS. 3, 4, and 13, the actuator engagement unit 182 extends from the locking lever shaft 105 toward the vehicle rear side, and the tip end portion thereof branches into a fork shape. The actuator engagement unit 182 is connected to a locking actuator 190 via the branching portion.

As shown in FIGS. 3 to 5, the locking actuator 190 is attached to a portion on the vehicle rearmost side of the base plate 101, and has a locking output lever 191 provided in a portion on the vehicle front side. The locking output lever 191 extends along the top surface of the base plate 101, and turns around an output lever shaft 190*a*. An engagement protrusion 192 provided at the tip end of the locking output lever 191 is engaged with the branching portion of the actuator engagement unit 182.

The locking actuator 190 functions as described below. When the locking output lever 191 is turned around the output lever shaft 190*a* clockwise to the extreme position in FIG. 4, the locking actuator 190 moves the lock-pin holding unit 181 downward via the actuator engagement unit 182, and positions the lock pin 201 in the rotational movement region of the lock-pin engagement unit 153 in the lock-pin slide groove 141*a* in the open lever 140, by which the control unit 100 is made in the unlocked state. On the other hand, when the locking output lever 191 is turned around the output lever shaft 190*a* counterclockwise to the extreme position in FIG. 4, the locking actuator 190 moves the lock-pin holding unit 181 upward via the actuator engagement unit 182, and positions the lock pin 201 out of the rotational movement region of the lock-pin engagement unit 153 in the lock-pin slide groove 141*a* in the open lever 140, by which the control unit 100 is made in the locked state.

On the other hand, as shown in FIGS. 3 and 4 to 16, the door opening/closing device has the inside handle IH. The inside handle IH includes a handle base member 300 and an operating handle member 310. The handle base member 300 and the operating handle member 310 are connected to each other via an operation shaft member 320 provided along the lengthwise direction of the handle base member 300, so that the operating handle member 310 can be tiltingly moved around the axis of the operation shaft member 320 with respect to the handle base member 300.

The operating handle member 310 has an operation output unit 311 only. The operation output unit 311 is a unit that extends in the direction opposed to the operating handle member 310 when the operation shaft member 320 is the center. The operation output unit 311 projects to a portion on the back surface side of the handle base member 300 via a cutout provided in the handle base member 300. The cross section of the operation output unit 311 is formed into a size such as to be inserted through the output-unit engagement hole 117 in the door operating lever 110.

When relative positioning is performed by using a positioning unit (not shown), provided between the inside handle IH and the base plate 101, for example, when a positioning pin provided on one of these elements is inserted through a positioning hole provided on the other thereof, the inside handle IH becomes a temporarily assembled state in which the operation output unit 311 of the operating handle member 310 is inserted into the output-unit engagement hole 117 in the door operating lever 110 via the insertion window hole 101*a* in the base plate 101 in the state in which the operation shaft member 320 extends along the up and down direction. From the temporarily assembled state, if a mounting screw is fastened through a mounting-screw insertion hole 300*a* provided in the handle base member 300 shown in FIG. 3 and a screw insertion hole 101*f* provided in the base plate 101 shown in FIG. 4, the door opening/closing device can be mounted onto the door inner panel IP of the slide door D. In this case, work for connecting the inside handle IH to the door operating lever 110 is not needed at all, and the mounting work can be performed easily.

Reference numeral 340 in FIG. 3 denotes a lock knob connected to the locking output lever 191 via a link rod 341. When the lock knob 340 is operated manually, the control unit 100 can be switched over from the locked state to the unlocked state and vice versa without the need for the operation of the locking actuator 190.

FIGS. 17 to 25 are schematic views showing the states of elements at the time when the control unit 100 is operated. Hereunder, the operation of the control unit 100 is explained with reference to these figures.

The control unit 100 is mounted on the door inner panel IP in such a manner that the operating handle member 310 of the inside handle IH is exposed to the vehicle interior side, and can be operated appropriately by the passenger.

Figure 17:
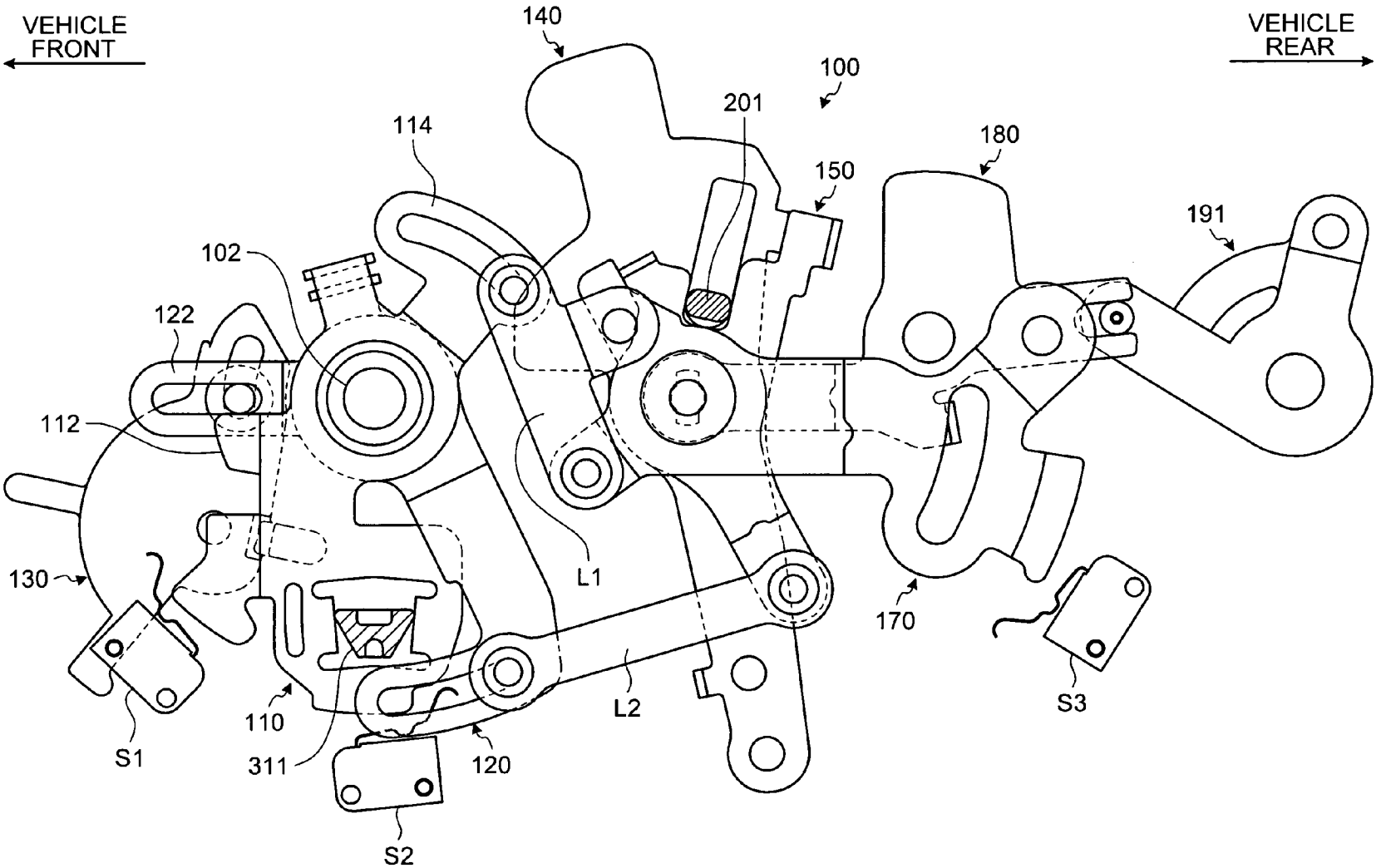
FIG. 17 is a schematic view of the initial state of the control unit shown in FIG. 3.

When the control unit 100 is in the initial state, the operating handle member 310 is at the neutral position, and as shown in FIG. 17, a state in which the operation output unit 311 is inserted through the output-unit engagement hole 117 in the door operating lever 110 held at the normal position is formed. In the initial state shown in FIG. 17, the pin slide unit 122 of the link lever 120 is held at the normal position at which the pin slide unit 122 extends along the link engagement unit 112 of the door operating lever 110 by the elastic force of the return spiral spring 103. Also, the open sub lever 150, the open lever 140, and the open handle lever 170 are in a state of being turned counterclockwise to the extreme position in the figure by the elastic force of the first coil spring 155. For convenience, in the initial state shown in FIG. 17, it is assumed that the child lock lever 130 is at the unlock position, and the control unit 100 is in the unlocked state.

Figure 15:
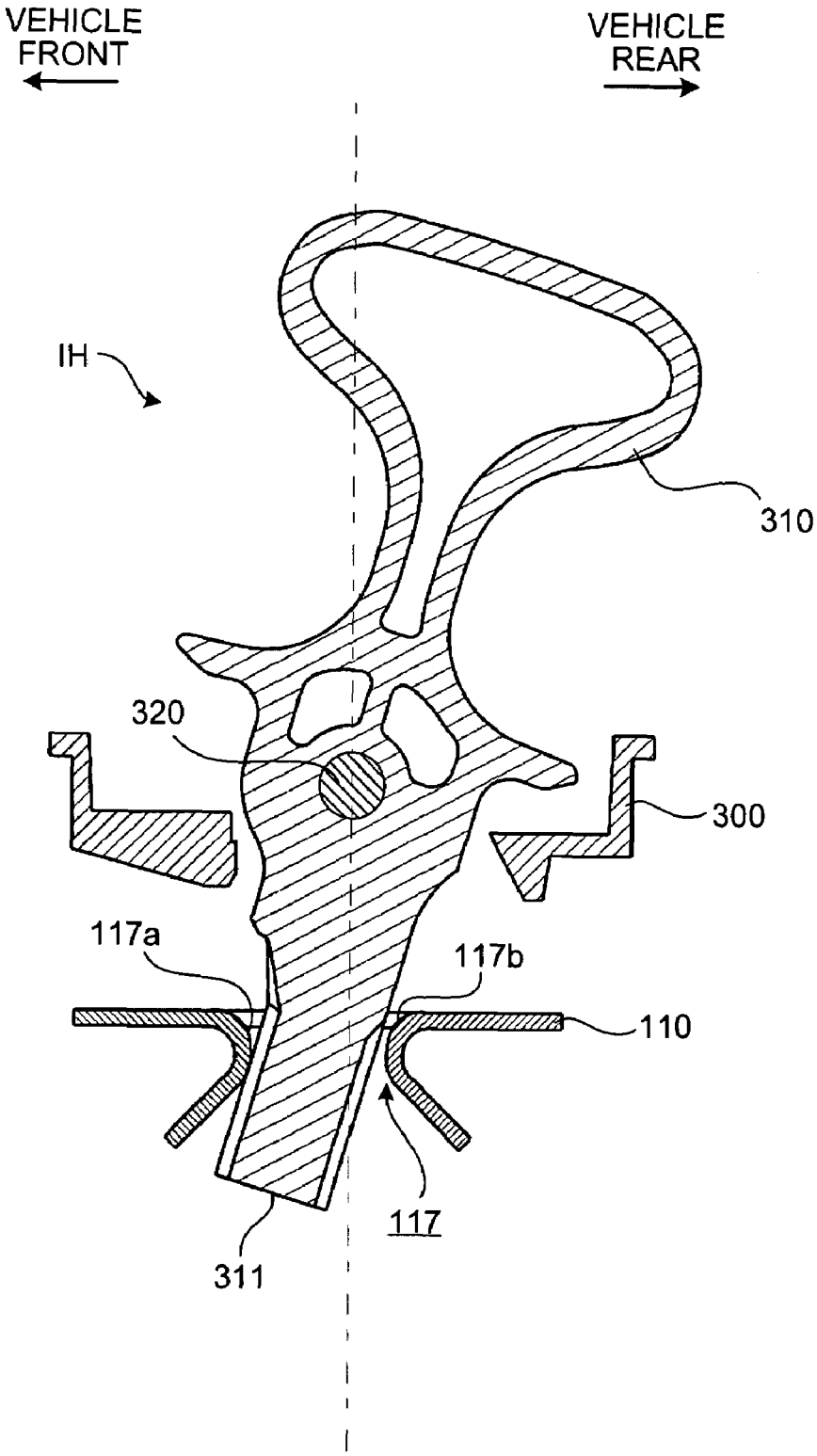
FIG. 15 is a transverse sectional view of a state in which the inside handle shown in FIG. 15 is operated to open the door.
Figure 19:
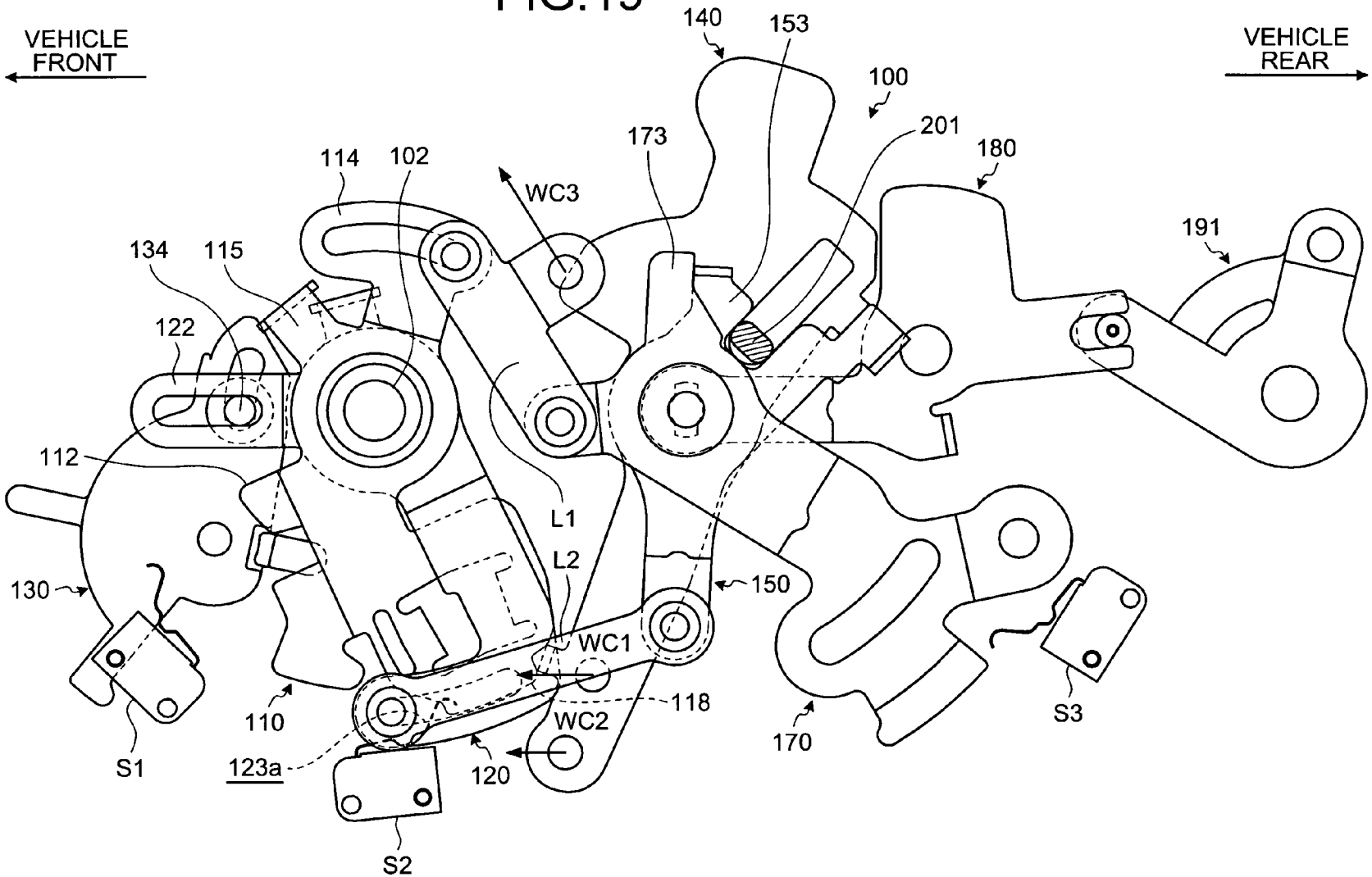
FIG. 19 is a schematic view of a state in which an inside handle is operated to close the door in the control unit shown in FIG. 3.

From the initial state, if the operating handle member 310 of the inside handle IH is tiltingly moved toward the vehicle rear side as shown in FIG. 15 (door opening operation of the inside handle IH), the operation output unit 311 is brought into contact with the front-side contact surface 117*a* of the output-unit engagement hole 117, and the door operating lever 110 is turned clockwise as shown in FIG. 19. If the door operating lever 110 is turned clockwise, the turning is transmitted to the link lever 120 via the link engagement unit 112 and the engagement pin 134, and thus the link lever 120 turns clockwise.

If the link lever 120 turns, the open sub lever 150 turns clockwise via the second connection link L2, and further the turning of the open sub lever 150 is transmitted to the open lever 140 via the lock-pin engagement unit 153 and the lock pin 201, so that the open lever 140 turns clockwise. Therefore, the first wire cable WC1 and the second wire cable WC2 are pulled.

If the first wire cable WC1 is pulled, the closed-door latch unit CR at the rear edge of the slide door D is released. If the second wire cable WC2 is pulled, the closed-door latch unit CR at the front edge of the slide door D is released. Therefore, for example, even if the slide door D is in the closed state, the closed door can be moved to open by the tiltingly moving operation of the inside handle IH to the vehicle rear side. If the first wire cable WC1 is pulled, the clutch mechanism of the closer device CL that the closed-door latch unit CR at the rear edge of the slide door D has becomes in the disengaged state. Therefore, for example, even in the state in which the closer device CL is operated, if the inside handle IH is tiltingly moved to the vehicle rear side, the transfer operation from the half latched state to the fully latched state can be interrupted.

When the door operating lever 110 turns clockwise, one end of the first connection link L1 moves appropriately in the first slide groove hole 114*a* in the door operating lever 110. Therefore, the first connection link L1 is not moved by the clockwise turning of the door operating lever 110.

Figure 18:
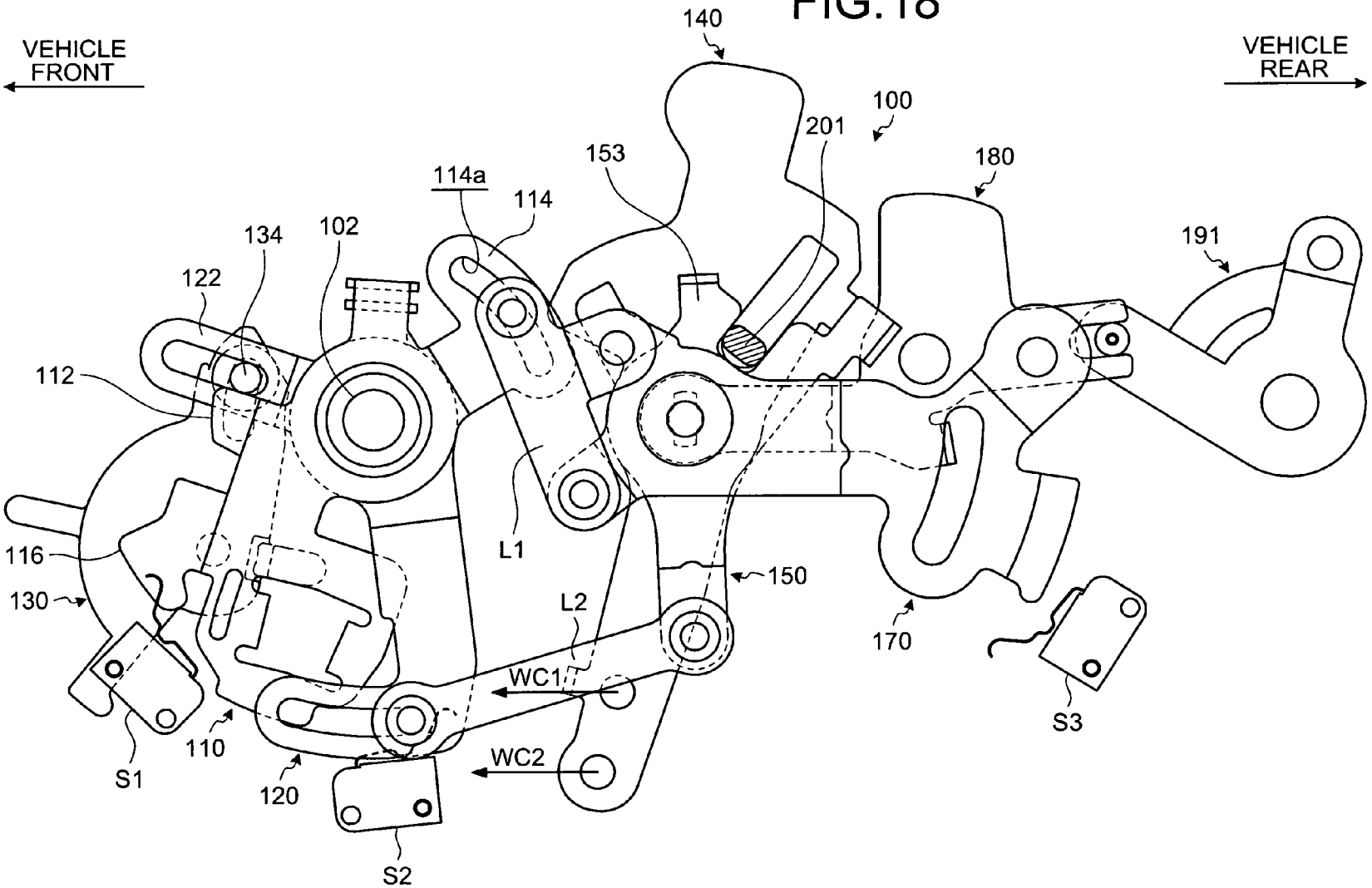
FIG. 18 is a schematic view of a state in which an inside handle is operated to open the door in the control unit shown in FIG. 3.

If the door operating lever 110 turns clockwise in FIG. 18, the door-opening detecting unit 116 turns on the first door-operation detecting sensor S1. Therefore, based on the detection result of the first door-operation detecting sensor S1, the tiltingly moving operation of the operating handle member 310 to the vehicle rear side can be detected.

Figure 16:
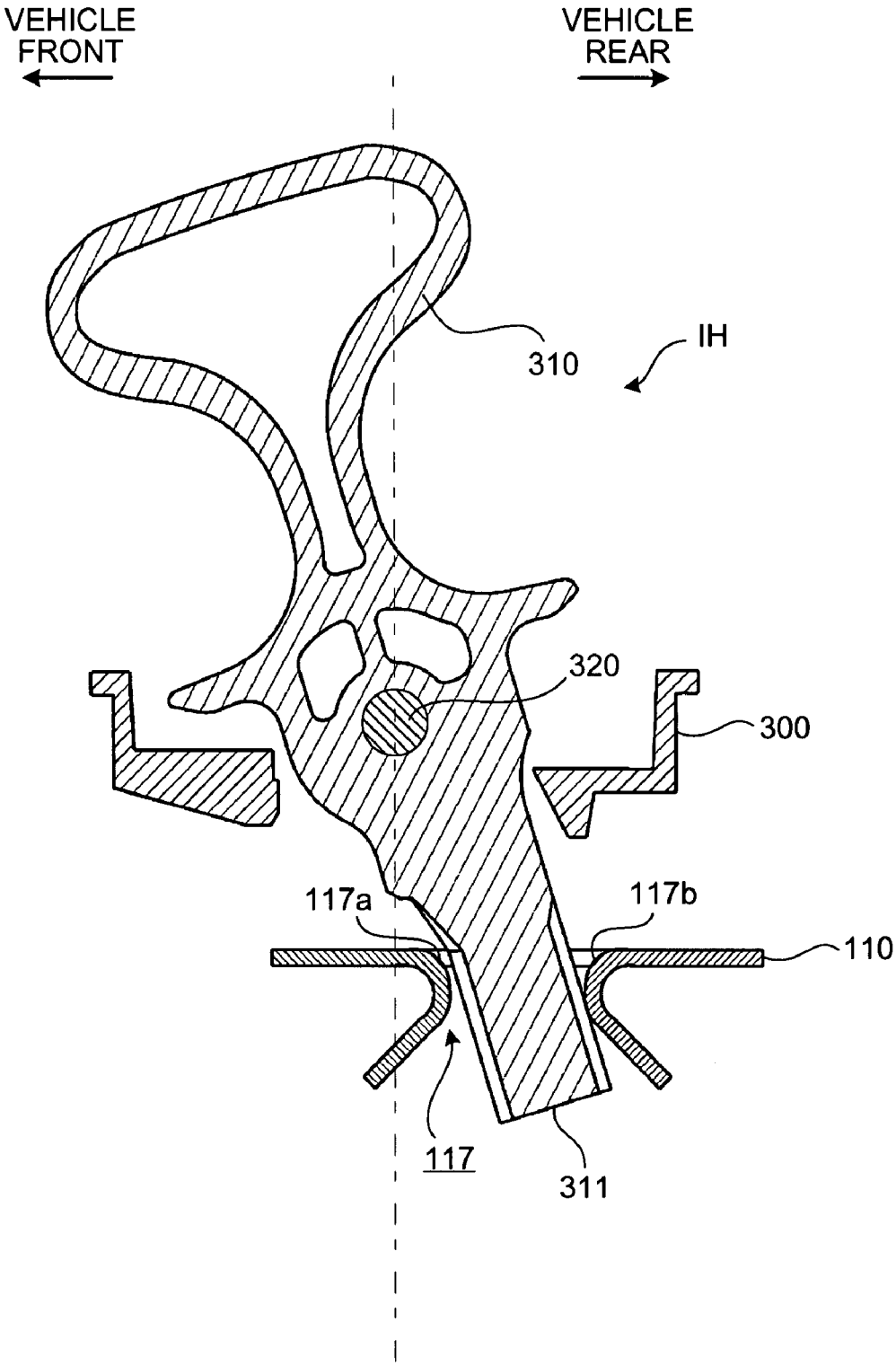
FIG. 16 is a transverse sectional view of a state in which the inside handle shown in FIG. 15 is operated to close the door.

If the operating handle member 310 of the inside handle IH is tiltingly moved from the initial state toward the vehicle front side as shown in FIG. 16 (door closing operation of the inside handle IH), the operation output unit 311 is brought into contact with the rear-side contact surface 117*b* of the output-unit engagement hole 117, and the door operating lever 110 is turned counterclockwise as shown in FIG. 19. If the door operating lever 110 is turned counterclockwise, the first connection link L1 is moved slantwise upward by the turning, and the third wire cable WC3 is pulled by the movement.

By the pulling of the third wire cable WC3, the open-door latch unit OR is released. As a result, for example, even if the slide door D is in the open state, the open door can be moved to close by the tiltingly moving operation of the inside handle IH to the vehicle front side.

If the door operating lever 110 turns counterclockwise, the turning is transmitted to the open handle lever 170 via the first connection link L1, by which the open handle lever 170 is turned clockwise. If the open handle lever 170 is turned clockwise, the turning is transmitted to the open sub lever 150 via the sub-lever engagement unit 173, by which the open sub lever 150 is turned clockwise. If the open sub lever 150 is turned clockwise, the turning is transmitted to the open lever 140 via the lock-pin engagement unit 153 and the lock pin 201, by which the open lever 140 is turned clockwise. If the open lever 140 is turned clockwise, the first wire cable WC1 and the second wire cable WC2 are pulled. In the operation described above, when the open sub lever 150 is turned by the turning of the open handle lever 170, the link engagement unit 112 of the door operating lever 110 and the engagement pin 134 separate from each other, and one end of the second connection link L2 moves appropriately in the second slide groove hole 123*a* in the link lever 120. Therefore, the link lever 120 is not operated by the counterclockwise turning of the door operating lever 110.

If the door operating lever 110 turns counterclockwise, the door closing detecting unit 118 turns on the second door-operation detecting sensor S2, so that the tiltingly moving operation of the operating handle member 310 to the vehicle front side can be detected based on the detection result of the second door-operation detecting sensor S2.

Figure 20:
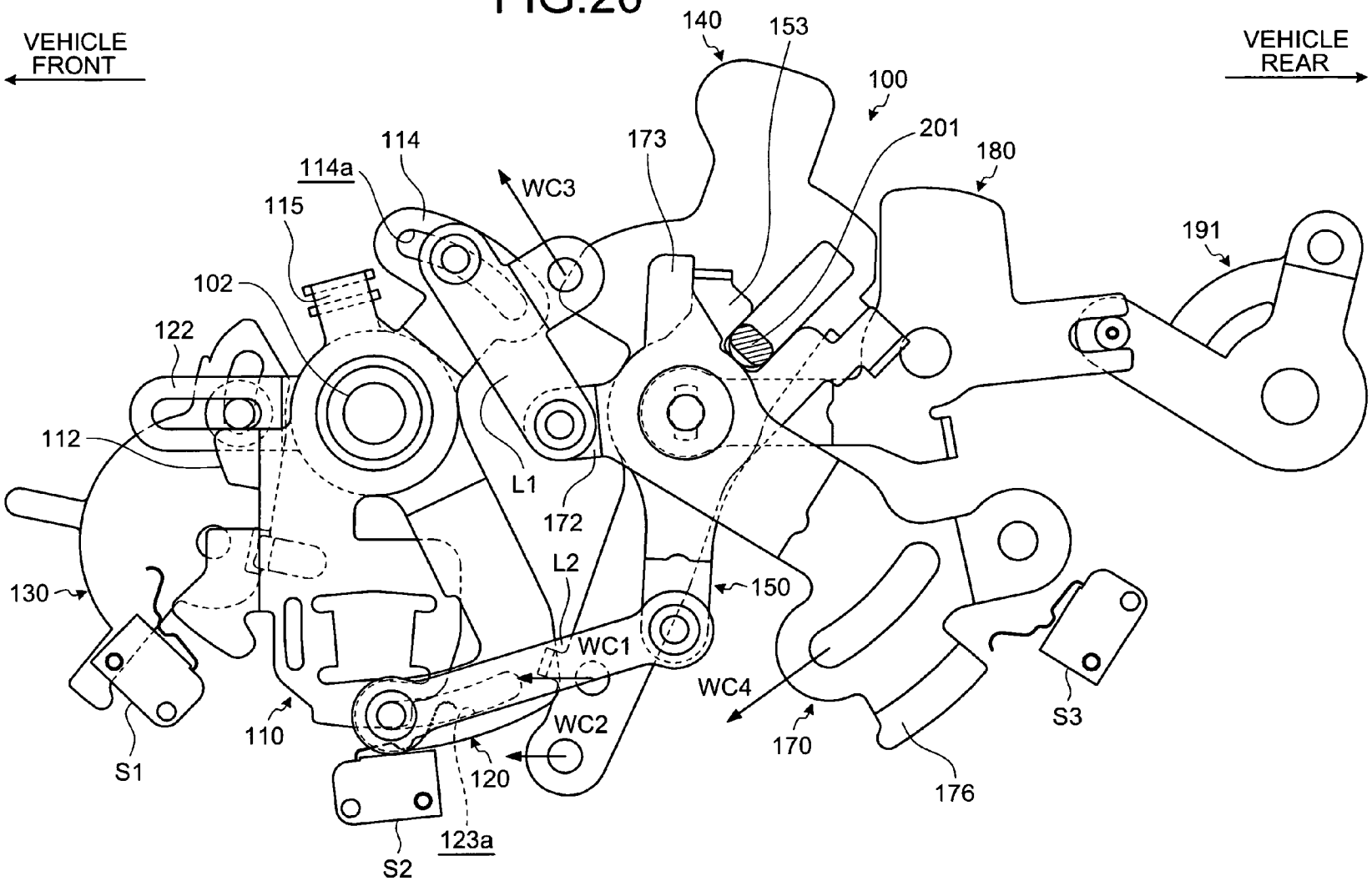
FIG. 20 is a schematic view of a state in which an outside handle is operated in the control unit shown in FIG. 3.

If the outside handle OH is operated from the initial state, tension is produced on the fourth wire cable WC4, and thus the open handle lever 170 is turned clockwise by the tension as shown in FIG. 20. If the open handle lever 170 is turned clockwise, the first connection link L1 is moved slantwise upward by the turning, and also the turning is transmitted to the open sub lever 150 via the sub-lever engagement unit 173 so that the open sub lever 150 turns clockwise.

If the first connection link L1 moves, the third wire cable WC3 is pulled by the movement, so that the open-door latch unit OR is released. As a result, for example, even if the slide door D is in the open state, the open door can be moved to close by the operation of the outside handle OH.

If the open sub lever 150 turns clockwise, the turning is transmitted to the open lever 140 via the lock-pin engagement unit 153 and the lock pin 201, so that the first wire cable WC1 and the second wire cable WC2 are pulled by the clockwise turning of the open lever 140. As a result, for example, even if the slide door D is in the closed state, the closed door can be moved to open by the operation of the outside handle OH. Also, for example, even in the state in which the closer device CL is operated, if the outside handle OH is operated, the transfer operation from the half latched state to the fully latched state can be interrupted.

In the operation described above, when the first connection link L1 is moved by the turning of the open handle lever 170, one end of the first connection link L1 moves appropriately in the first slide groove hole 114*a* in the door operating lever 110, so that the door operating lever 110 is not operated by the clockwise turning of the open handle lever 170. Similarly, when the open sub lever 150 is turned by the turning of the open handle lever 170, one end of the second connection link L2 moves appropriately in the second slide groove hole 123*a* in the link lever 120. Therefore, the link lever 120 is not operated by the clockwise turning of the open sub lever 150.

If the open handle lever 170 turns clockwise, the third door-operation detecting unit 176 turns on the third door-operation detecting sensor S3, so that the operation of the outside handle OH can be detected based on the detection result of the third door-operation detecting sensor S3.

Figure 21:
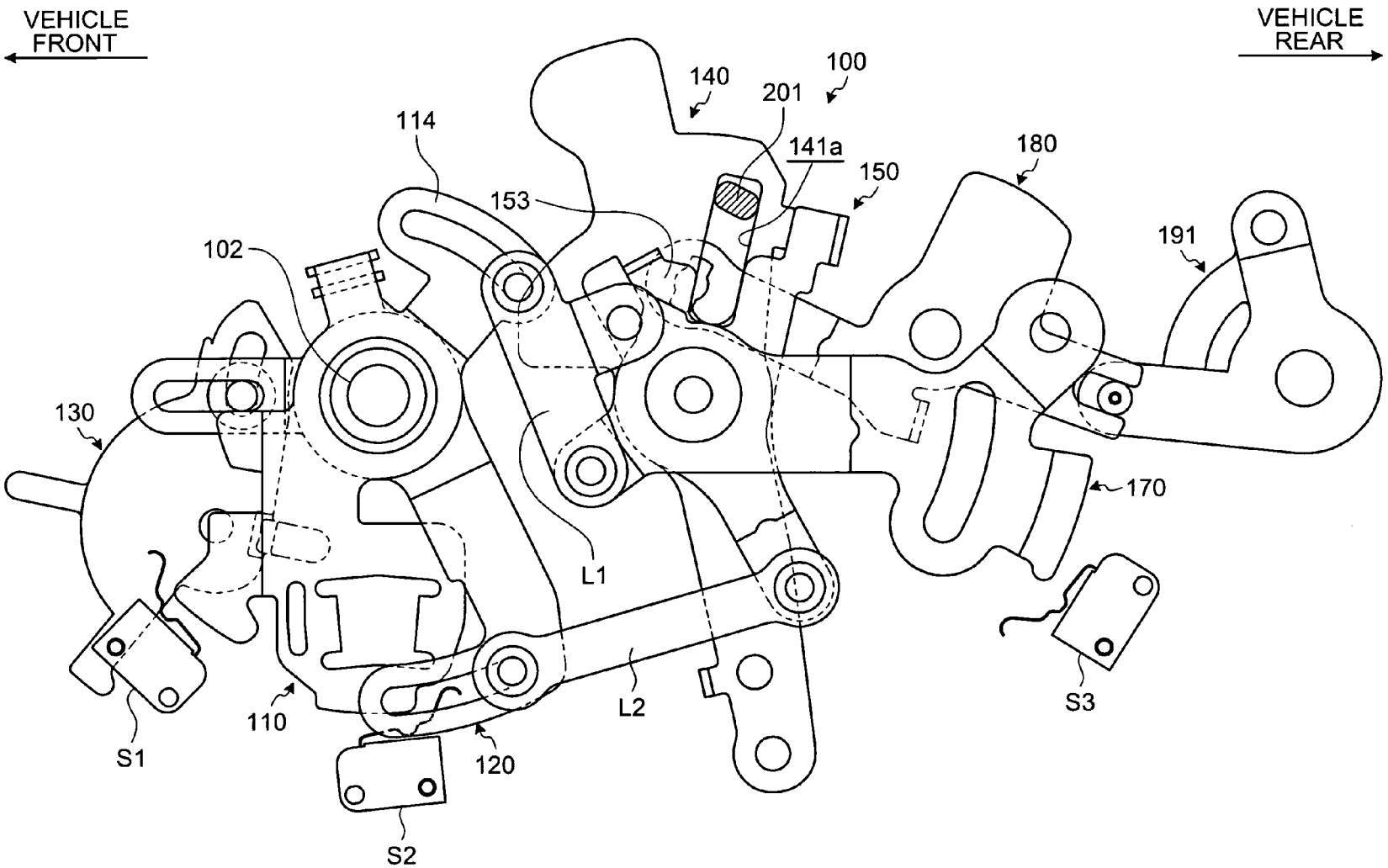
FIG. 21 is a schematic view of the locked state of the control unit shown in FIG. 3.
Figure 22:
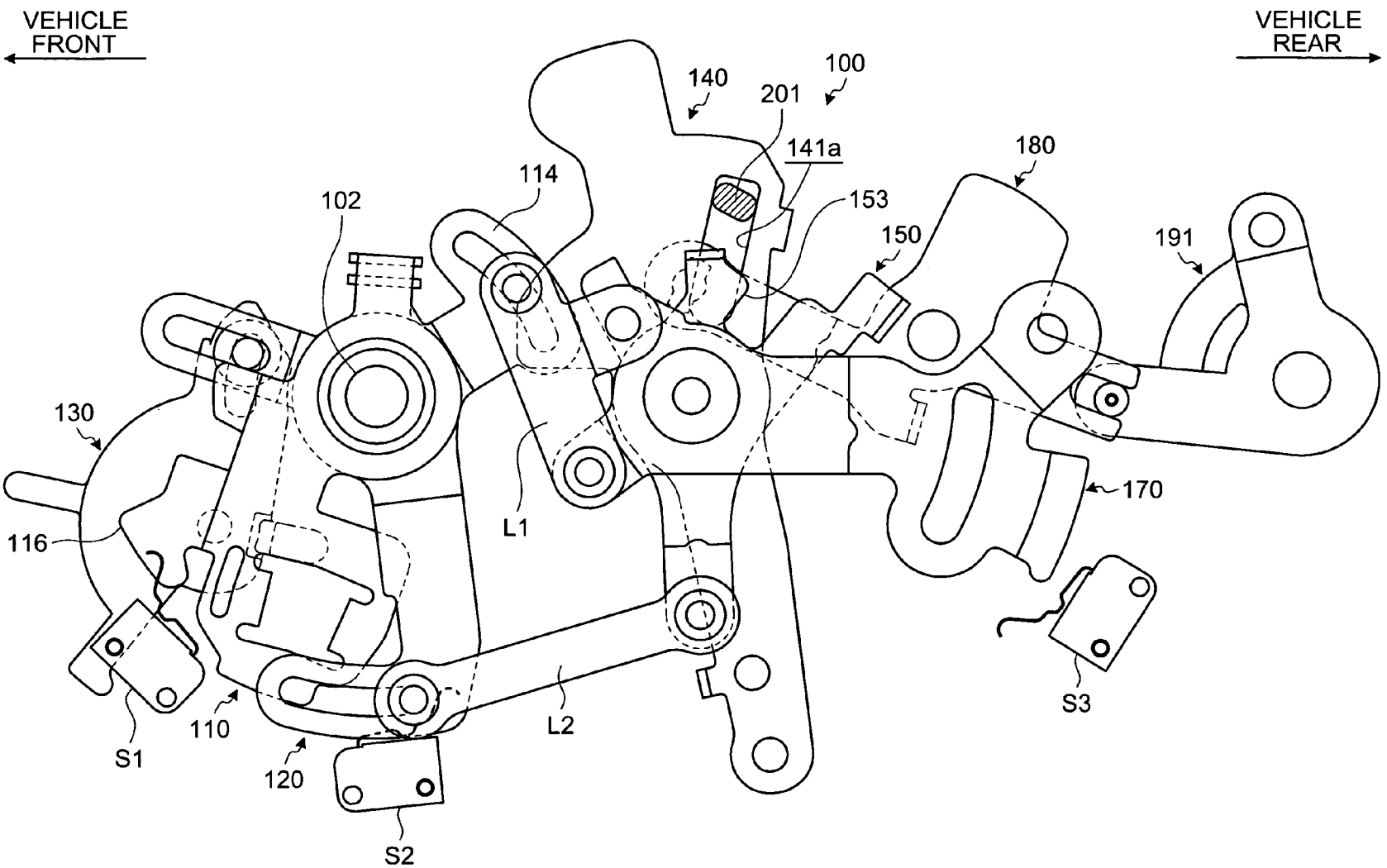
FIG. 22 is a schematic view of a state in which an inside handle is operated to open the door when the control unit shown in FIG. 3 is in the locked state.

If the control unit 100 is switched over from the initial state to the locked state, as shown in FIG. 21, in the lock-pin slide groove 141*a* in the open lever 140, the lock pin 201 is positioned out of the rotational movement region of the lock-pin engagement unit 153. Therefore, when the inside handle IH is tiltingly moved from the locked state toward the vehicle rear side, as shown in FIG. 22, the clockwise turning of the door operating lever 110 is transmitted to the open sub lever 150 via the link lever 120 and the second connection link L2, but the turning of the open sub lever 150 is not transmitted to the open lever 140. As a result, the closed-door latch unit CR is not released, so that, for example, when the slide door D is in the closed state, the slide door D cannot be moved to open. However, even in the locked state, the door-opening detecting unit 116 turns on the first door-operation detecting sensor S1 when the door operating lever 110 turns. Therefore, the tiltingly moving operation of the inside handle IH to the vehicle rear side can be detected based on the detection result of the first door-operation detecting sensor S1. For example, when the slide door D is in the open state, if the inside handle IH is tiltingly moved from the locked state toward the vehicle front side, the first connection link L1 moves slantwise upward so that tension is produced on the third wire cable WC3 by the counterclockwise turning of the door operating lever 110.

Thereby, the open-door latch unit OR can be released. In other words, for example, when the slide door D is in the open state and in the locked state, the slide door D can be moved to close by the tiltingly moving operation of the inside handle IH.

Figure 23:
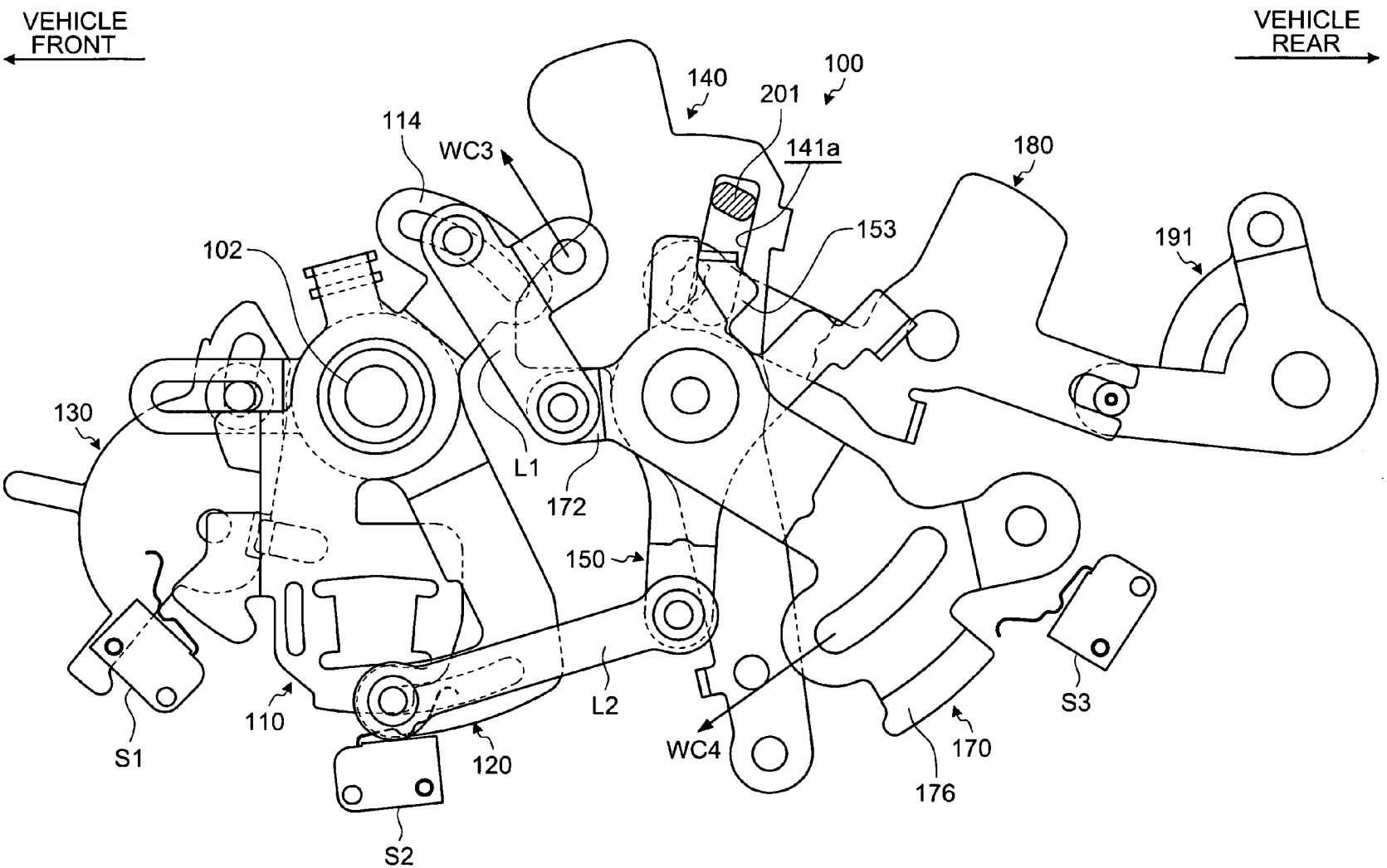
FIG. 23 is a schematic view of a state in which an outside handle is operated when the control unit shown in FIG. 3 is in the locked state.

When the outside handle OH is operated from the locked state shown in FIG. 21, as shown in FIG. 23, the turning of the open sub lever 150 caused by the turning of the open handle lever 170 is not transmitted to the open lever 140. As a result, the closed-door latch unit CR is not released. For example, when the slide door D is in the closed state, the slide door D cannot be moved to open. However, even in the locked state, the first connection link L1 moves slantwise upward so that the third wire cable WC3 is pulled. Therefore, for example, when the slide door D is in the open state, the slide door D can be moved to close by the operation of the outside handle OH. Also, even in the locked state, the third door-operation detecting unit 176 turns on the third door-operation detecting sensor S3 when the open handle lever 170 turns. Therefore, the operation of the outside handle OH can be detected based on the detection result of the third door-operation detecting sensor S3.

Figure 24:
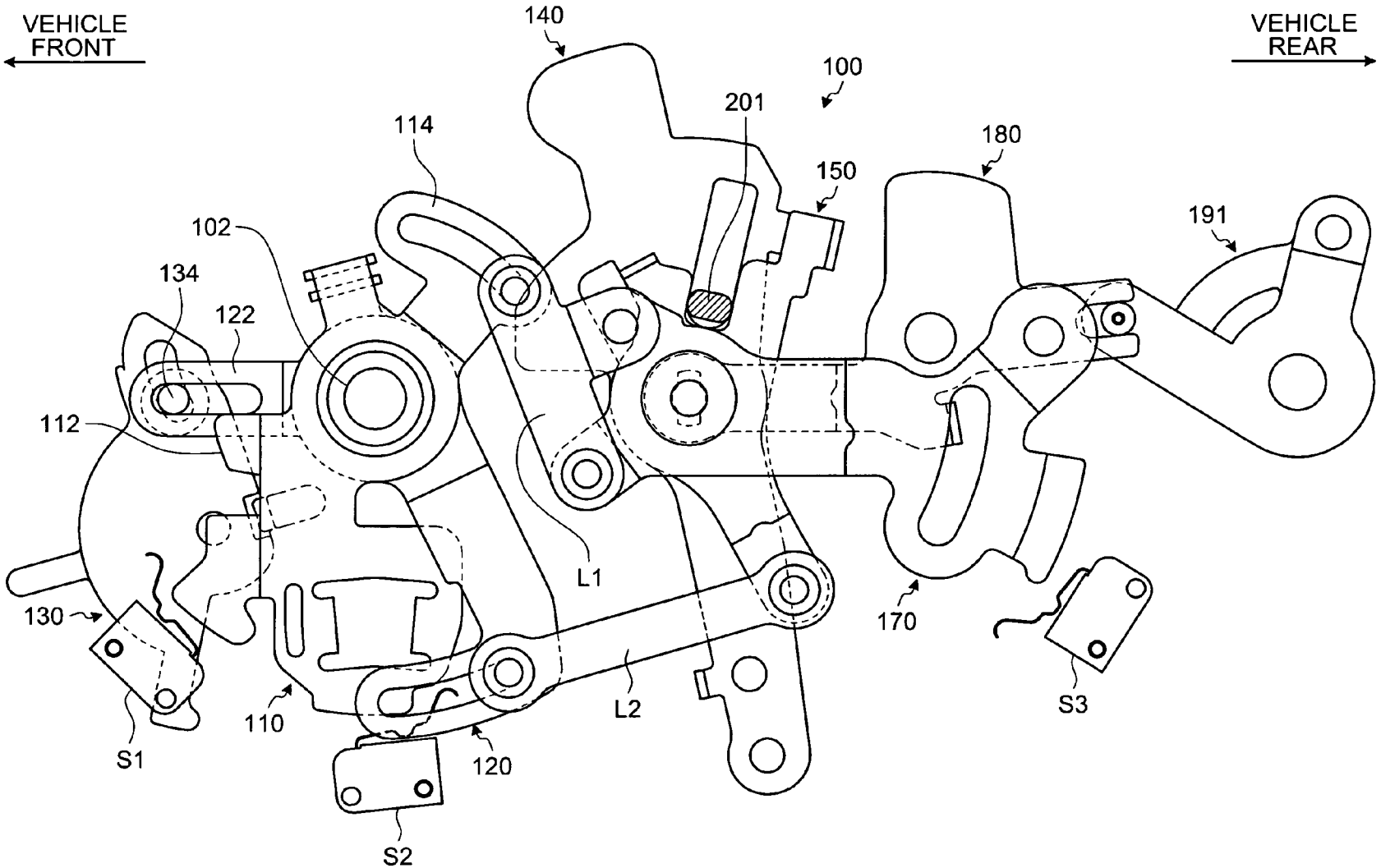
FIG. 24 is a schematic view of the child lock state of the control unit shown in FIG. 3.
Figure 25:
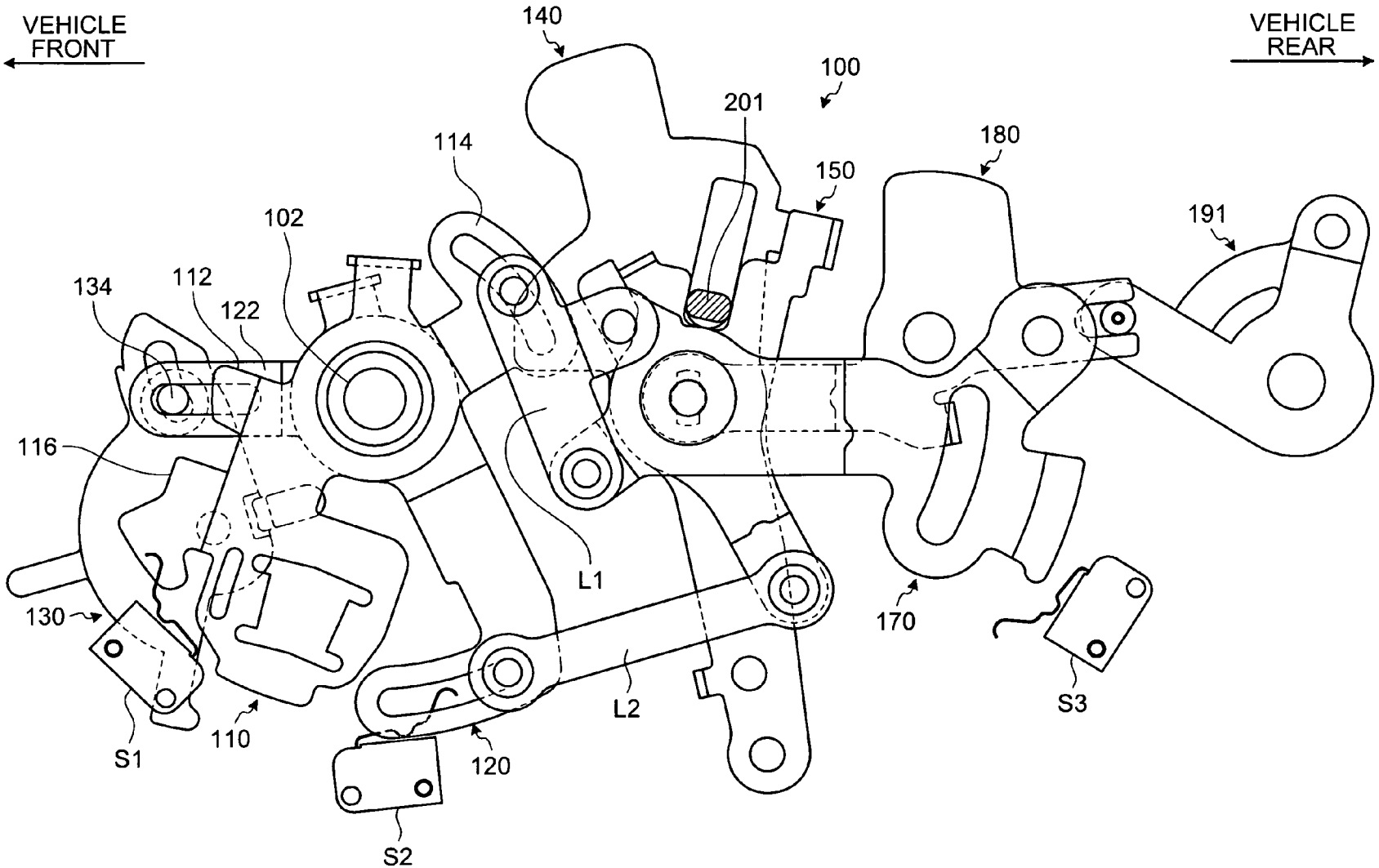
FIG. 25 is a schematic view of a state in which an inside handle is operated to open the door when the control unit shown in FIG. 3 is in the child lock state.

On the other hand, if the child lock lever 130 is switched over from the initial state to the locked position, as shown in FIG. 24, in the pin slide unit 122 of the link lever 120, the engagement pin 134 is positioned out of the rotational movement region of the link engagement unit 112 of the door operating lever 110. Therefore, even if the inside handle IH is tiltingly moved from the state toward the vehicle rear side, as shown in FIG. 25, the turning of the door operating lever 110 is not transmitted to the link lever 120. That is to say, since the link engagement unit 112 does not come into contact with the engagement pin 134, the link lever 120 does not turn, and hence the closed-door latch unit CR is not released. When the door operating lever 110 turns, the door-opening detecting unit 116 turns on the first door-operation detecting sensor S1. Therefore, the tiltingly moving operation of the inside handle IH to the vehicle rear side can be detected based on the detection result of the first door-operation detecting sensor S1. However, if the inside handle IH is tiltingly moved toward the vehicle front side in the state in which the child lock lever 130 is switched over to the locked state, the first connection link L1 moves slantwise upward, and the third wire cable WC3 is pulled by the movement, so that the slide door D can be moved to close.

If the control unit 100 is in the unlocked state in the state in which the child lock lever 130 is switched over to the locked state, the first connection link L1 moves slantwise upward so that the third wire cable WC3 is pulled by the operation of the outside handle OH, and also the first wire cable WC1 and the second wire cable WC2 are pulled by the clockwise turning of the open sub lever 150. Therefore, the slide door D can be moved to open and close.

As described above, according to the door opening/closing device of this embodiment, by bringing the operation output unit 311 formed on the inside handle IH into direct contact with the door operating lever 110, the power is transmitted from one element to another. Therefore, work for connecting the inside handle IH and the door operating lever 110 to each other is not needed, and the assembling work can be performed easily. Moreover, since the open-door latch unit OR and the closed-door latch unit CR are released selectively by one door operating lever 110, the assembling work can be made easy by a decrease in the number of parts handled. Also, between the door operating lever 110 and the open-door latch unit OR, the door opening/closing device includes the first connection link L1 connected to the door operating lever 110 and the third wire cable WC3 one end of which is connected to the first connection link L1 and the other end of which is connected to the open-door latch unit OR to connect the first connection link L1 and the open-door latch unit OR to each other. Therefore, when door operating lever 110 is turned to the second direction, a lever member that transmits the turning operation to the open-door latch unit OR need not be provided between the door operating lever 110 and the open-door latch unit OR. Therefore, since the lever member having the function described above need not be provided, the assembling work can be made easy by a decrease in the number of parts handled.

According to the present invention, by bringing the operation output unit formed on the inside handle into direct contact with the door operating lever, the power is transmitted from one element to another. Therefore, work for connecting the inside handle and the door operating lever to each other is not needed, and the assembling work can be performed easily. Moreover, since the open-door holding unit and the closed-door holding unit are released selectively by one door operating lever, the assembling work can be made easy by a decrease in the number of parts handled. Also, between the door operating lever and the open-door holding unit, the door opening/closing device includes the link member connected to the door operating lever and the connecting member one end of which is connected to the link member and the other end of which is connected to the open-door holding unit to connect the link member and the open-door holding unit to each other, and when the door operating lever is turned to the second direction, the link member releases the open-door holding unit via the connecting member. Therefore, when door operating lever is turned to the second direction, a lever member that transmits the turning operation to open-door holding unit need not be provided between the door operating lever and the open-door holding unit. Therefore, since the lever member having the function described above need not be provided, the assembling work can be made easy by a decrease in the number of parts handled.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A door opening/closing device for a slide door that permits an opening movement of the slide door with respect to a vehicle body by releasing a closed-door holding mechanism when an inside handle is operated to open the door, and that permits a closing movement of the door with respect to the vehicle body by releasing an open-door holding mechanism when the inside handle is operated to close the door, the door opening/closing device comprising:

a door operating lever that releases the closed-door holding mechanism when being turned to a first direction and releases the open-door holding mechanism when being turned to a second direction arranged on a base plate by a rotating shaft member, and an operation output mechanism formed on the inside handle so as to engage with the door operating lever, wherein when the inside handle is operated to open or close the door, the door operating lever is turned in a desired direction by bringing the operation output mechanism into contact with the door operating lever; and a link member, arranged between the door operating lever and the open-door holding mechanism and connected to the door operating lever and a connecting member, one end of which is connected to the link member and the other end of which is connected to the open-door holding mechanism to connect the link member and the open-door holding mechanism to each other, and when the door operating lever is turned to the second direction, the link member releases the open-door holding mechanism via the connecting member, wherein the closed-door holding mechanism holds the slide door in a closed state with respect to the vehicle body, and is provided between a rear edge portion of the slide door and the vehicle body, and wherein the open-door holding mechanism holds the slide door in an open state with respect to the vehicle body, and is provided between a support frame on the slide door and the vehicle body.

2. The door opening/closing device according to claim 1, further comprising a second door-operating lever that releases the closed-door holding mechanism and releases the open-door holding mechanism when an outside handle is operated arranged on the base plate by a second rotating-shaft member, wherein the link member is connected to a third rotating-shaft members, one end of which is connected to the door operating lever and the other end of which is arranged on the second door-operating lever.

3. A door opening/closing device that permits an opening movement of a door with respect to a vehicle body by releasing a closed-door holding mechanism when an inside handle is operated to open the door, and that permits a closing movement of the door with respect to the vehicle body by releasing an open-door holding mechanism when the inside handle is operated to close the door, the door opening/closing device comprising:

a door operating lever that releases the closed-door holding mechanism when being turned to a first direction and releases the open-door holding mechanism when being turned to a second direction arranged on a base plate by a rotating shaft member, and an operation output mechanism formed on the inside handle so as to engage with the door operating lever, wherein when the inside handle is operated to open or close the door, the door operating lever is turned in a desired direction by bringing the operation output mechanism into contact with the door operating lever;

a link member, arranged between the door operating lever and the open-door holding mechanism and connected to the door operating lever and a connecting member, one end of which is connected to the link member and the other end of which is connected to the open-door holding mechanism to connect the link member and the open-door holding mechanism to each other, and when the door operating lever is turned to the second direction, the link member releases the open-door holding mechanism via the connecting member; and a second door-operating lever that releases the closed-door holding mechanism and releases the open-door holding mechanism when an outside handle is operated arranged on the base plate by a second rotating-shaft member, wherein the link member is connected to a third rotating-shaft member, one end of which is connected to the door operating lever and the other end of which is arranged on the second door-operating lever.

* * * * *